US006655336B2

(12) United States Patent
Arlton

(10) Patent No.: US 6,655,336 B2
(45) Date of Patent: Dec. 2, 2003

(54) HAND-HELD STARTING DEVICE FOR MODEL ENGINES

(76) Inventor: Paul E. Arlton, 3279 Secretariat Cir., West Lafayette, IN (US) 47906

( * ) Notice: Subject to any disclaimer, the term of this patent is extended or adjusted under 35 U.S.C. 154(b) by 257 days.

(21) Appl. No.: 09/870,810

(22) Filed: May 31, 2001

(65) Prior Publication Data

US 2002/0046723 A1 Apr. 25, 2002

Related U.S. Application Data

(60) Provisional application No. 60/208,143, filed on May 31, 2000.

(51) Int. Cl.[7] ..... F02N 11/12
(52) U.S. Cl. ..... 123/179.27
(58) Field of Search ..... 123/179.27, DIG. 3; 446/57; 173/217; 81/489, 57.31

(56) References Cited

U.S. PATENT DOCUMENTS 2,475,750 A * 7/1949 McCormick et al. .. 123/179.27
3,939,369 A * 2/1976 Sullivan ..... 123/185.7
6,085,711 A * 7/2000 Gerst ..... 123/179.27
D446,433 S * 8/2001 Bass et al. ..... D8/62
6,321,417 B1 * 11/2001 Zhang ..... 81/489
D471,069 S * 3/2003 Price et al. ..... D8/61

OTHER PUBLICATIONS

Kavan, 12 V Planetary Geared Starter, Product Brochure, 2 pages, date unknown.

Haggard & Stocking Associates, Inc., Product Catalog, pp. 228 and 232, 1995.

Reynolds Machine & Tool Corporation, rmt Redbook, p. 793, 1999.

* cited by examiner

*Primary Examiner*—Henry C. Yuen
*Assistant Examiner*—Arnold Castro
(74) *Attorney, Agent, or Firm*—Barnes & Thornburg

(57) ABSTRACT

A hand-held starter apparatus for starting model engines includes a motor, a body supporting the motor, a switching device that activates the motor, and a trigger in communication with the switching device. The body is configured for comfortable gripping by users with large hands and by users with small hands.

102 Claims, 18 Drawing Sheets

A

B

C

D

E

F

HAND-HELD STARTING DEVICE FOR MODEL ENGINES

This patent application claims priority under 35 U.S.C. 119(e) to U.S. Provisional Application Ser. No. 60/208,143, filed May 31, 2000, which is expressly incorporated by reference herein.

BACKGROUND AND SUMMARY OF THE INVENTION

The present invention relates to engine starters, and particularly to starters for model engines. More particularly, the present invention relates to hand-held starters for model engines used in model helicopters, airplanes and cars.

Model engines, such as those commonly used on model airplanes, typically do not include an automatic starting feature, but are sometimes started by hand. Manual starting requires a skilled operator, and is often difficult if the model engine is not properly adjusted. Hand-held electric starter motors are now in widespread use and make starting a model engine much easier. These devices typically consist of a high-torque electric motor held in the palm of the operator's hand and actuated by a finger switch. Such devices are applied to an output shaft of the model engine to turn the model engine at high speed while the operator performs appropriate engine starting procedures. Once the model engine is running, the electric starter motor is disconnected from the engine and set aside.

The minimum amount of torque that a starter motor must produce to start a model engine is generally dictated by the size of the model engine with which the starter motor is used. Traditional hand-held starters are bulky and cumbersome, partly because they are sized to start large model engines, and partly because the finger switch of these starters is commonly located on the motor housing itself thereby increasing the effective diameter of the motor and the associated hand-grip diameter. Large diameter starters are not well suited for use by operators with small hands such as children or teenagers.

Most commercially available starters are designed to start model engines of 0.10 cubic inch displacement to 0.60 cubic inch displacement and are called "standard" or "medium" starters. Starters capable of starting up to about 1.5 cubic inch displacement engines are termed "high torque" starters. Medium and high torque starters generally operate at relatively low rotational speeds of between 3000 revolutions per minute (RPM) and 6000 RPM, which is too slow to easily start small model engines below 0.10 cubic inch displacement. Such small model engines start more easily when turned at a high speed of 10,000 RPM to 15,000 RPM.

As populations increase and recreational sites become scarce, smaller models and model engines are becoming more popular. These small models are suitable for younger modelers who have small hands and who cannot comfortably operate a large electric starter. What is needed is a hand-held starting device suitable for small engines and adapted for use by operators with small hands as well as by operators with large hands.

According to the present disclosure, a hand-held starter apparatus for starting model engines includes a motor, a body supporting the motor, a switching device that activates the motor, and a trigger in communication with the switching device. The body is configured for comfortable gripping by users with large hands and by users with small hands.

In preferred embodiments, the motor is a high-speed starter motor having a shaft that rotates about a motor rotation axis and having an adapter assembly that is coupled to the shaft and that is configured to couple to an engine shaft of a model engine to transfer rotational motion from the starter motor to the model engine. In an illustrative embodiment, the body has a front portion which is generally circular in cross-section near the starter motor and a rear portion which is generally elliptical or oval in cross-section to more comfortably accommodate the small ("ring" and "pinky") fingers of the operator's hand. The trigger switch is preferably located behind the starter motor to minimize the diameter of the body adjacent to the starter motor. The trigger extends from the body in a forward direction over the motor and is actuated by the fingers or palm of the operator's hand.

According to this disclosure, the body includes a forward ridge and a rear ridge to axially position the operator's hand during operation of the hand-held starter apparatus. A front guard is provided to protect against accidental finger injury during starting of a model engine and to prevent accidental depression of the trigger when the hand-held starter apparatus is placed on a hard, flat surface such as the ground or a table after use.

In contrast to existing hand-held industrial motors such as electric and air powered die grinders which are generally cylindrical, the illustrative body narrows and is configured to accommodate the small fingers of the hand and support the hand grip of the operator against axial force, such as the force required to hold the starter motor against a shaft of a model engine during starting. The illustrative body is suitable for use in a vertical orientation where the axial holding features of the body provide a positive hand-hold against gravity even when the exterior of the device is coated with slippery engine exhaust oil from a model engine.

When equipped with a high-speed 10,000 RPM to 15,000 RPM motor, the starter apparatus of the present disclosure is ideally suited to start small engines of less than 0.10 cubic inch displacement. Furthermore, the illustrative apparatus is small and maneuverable enough to be used as a hobby tool in addition to a model engine starter, and an adapter is provided to accommodate commercially available rotary cutting and grinding tools. An alternative portable embodiment having an on-board battery is also shown and described in this disclosure.

This disclosure, therefore, relates to a hand-held starting device for model engines, and particularly, to a hand-held starter motor that can be rotationally coupled to a model internal combustion engine to impart rotational motion to the model engine to induce the model engine to start and continue operating under its own power. The illustrative apparatus is suitable for starting model airplane, car, helicopter, and boat engines and is configured to be operated by operators whose hands are generally smaller than those of adults. Thus, the disclosed apparatus is uniquely configured to accommodate small hands safely and comfortably. The disclosed apparatus alternatively can be configured to operate as a portable rotary hand-tool.

Additional features of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which:

FIG. 24 is a side elevation view of a hand-held starter apparatus in accordance with an alternative embodiment showing a power pack coupled to the body of the alternative embodiment by a front brace and by a rear electric-wire conduit and showing a battery pack (in phantom) carried by the power pack.

DETAILED DESCRIPTION OF THE DRAWINGS

Figure 1:
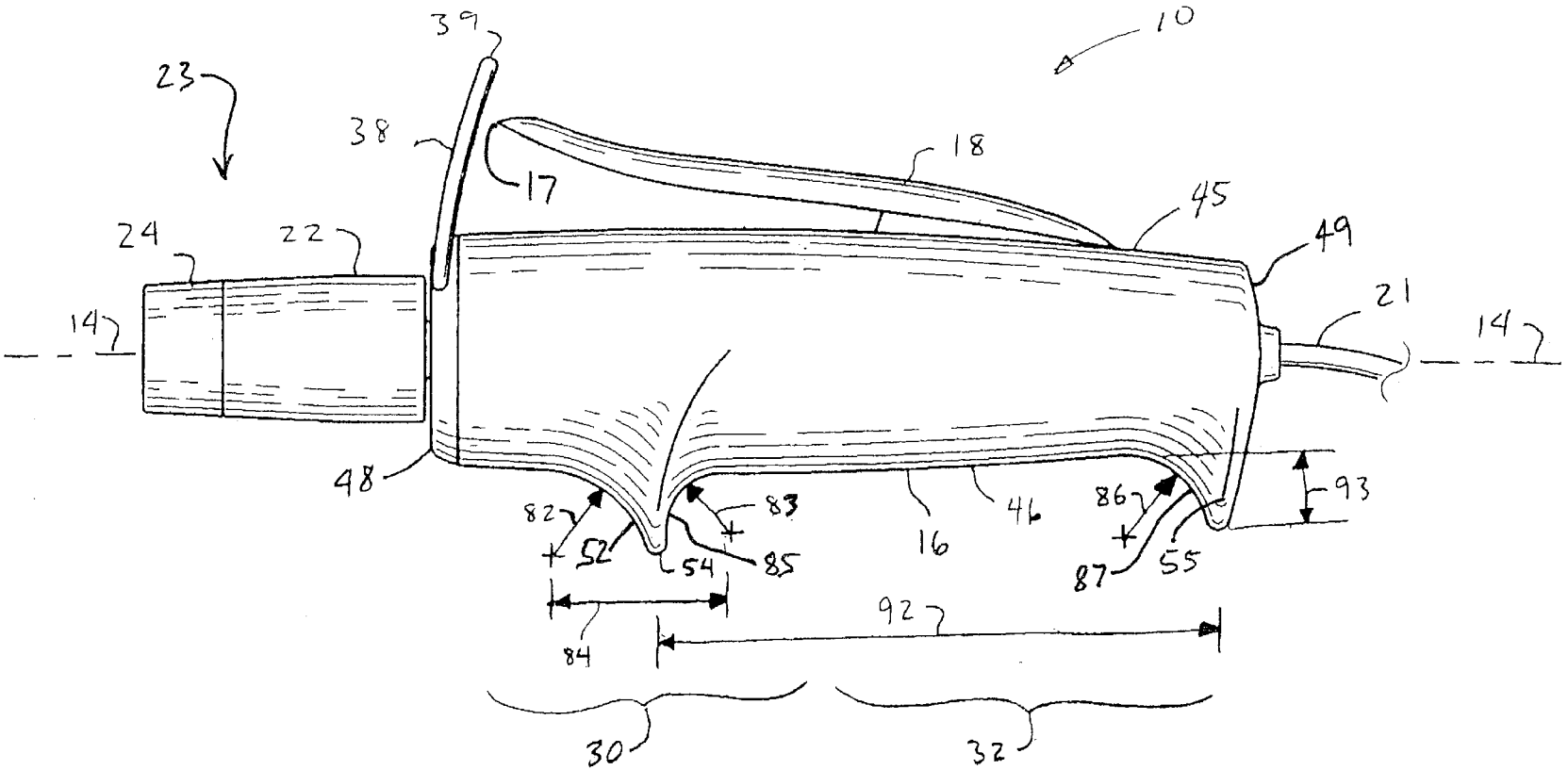
FIG. 1 is a side elevation view of a hand-held starter apparatus in accordance with the disclosure showing a body that is configured to be hand held, the body including a pair of downwardly extending ridges between which is defined a finger-receiving space, an adapter assembly to the left of the body, a trigger having portions located above the body, and a front guard extending upwardly from a front end of the body between the trigger and the adapter assembly.
Figure 2:
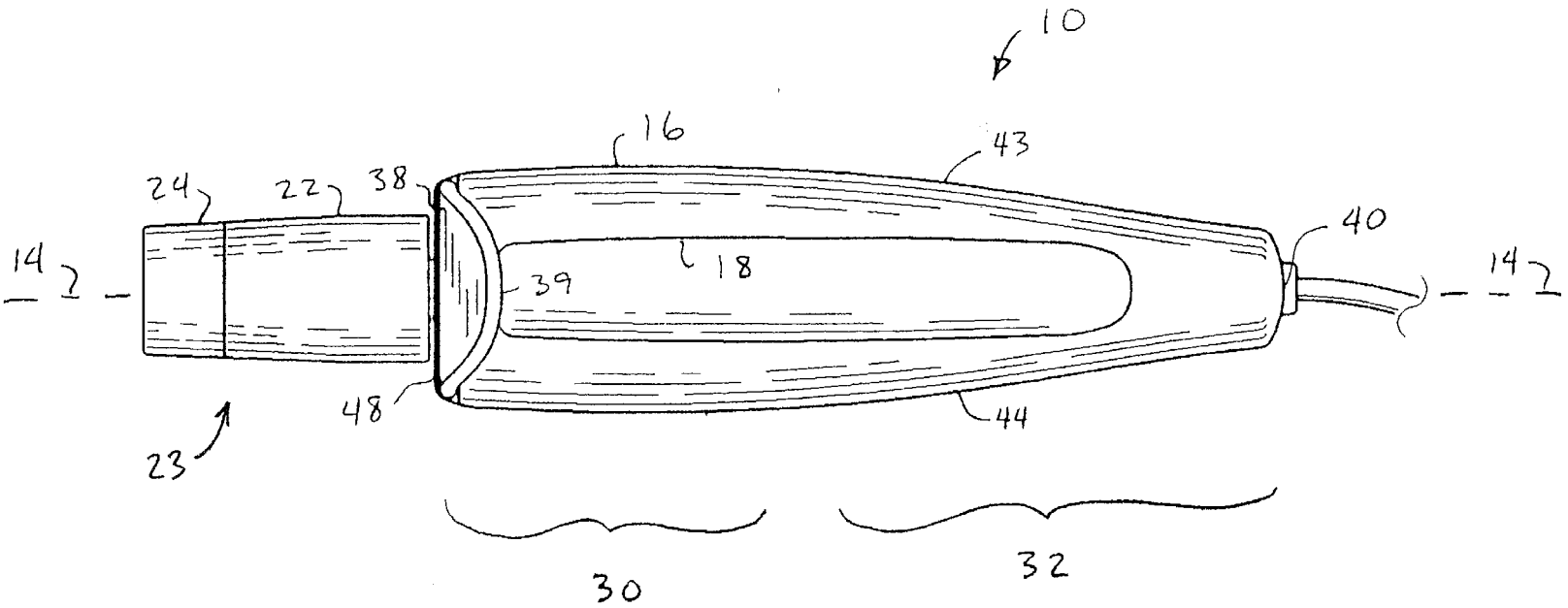
FIG. 2 is a top plan view of the hand-held starter apparatus of FIG. 1 showing the body being formed to include curved side profiles.

Referring to FIGS. 1, 2, 3, 4 and 12, a hand-held starting device or starter apparatus 10 is shown to scale in the drawings and comprises a starter motor 12 having shaft 11 that rotates about a motor rotation axis 14, a body 16 adapted to support starter motor 12 and accommodate a variety of sizes of hands 15, a trigger 18 in the form of a trigger lever in communication with a switch 20 to actuate starter motor 12, adapter hub assembly 23 having an adapter hub 22 connected to starter motor 12 and a coupling adapter 24 connected to adapter hub 22, said coupling adapter 24 adapted to couple starter motor 12 to shaft 26 of a model engine 28 to transfer rotational motion from shaft 11 of starter motor 12 to model engine 28. In a preferred embodiment, coupling adapter 24 is made of an elastomeric material such as rubber or silicone that conforms to the shape of an end-receptor of model engine shaft 26 such as propeller spinner 27 on a model airplane (not shown).

Wires 21 connect switch 20 and motor 12 to a power supply such as a 12 volt battery (not shown). In a preferred embodiment, starter motor 12 is a model no. SJ550 electric motor which is available from Hankscraft Motors of Reedsburg, Wis., and which is configured with windings for 15,000 RPM at 6 or 12 volts (depending upon the power source). Similar motors are commonly available for use in radio-controlled cars and may be used in lieu of the preferred motor to provide starter apparatus 10 with desired torque or RPM characteristics.

Figure 25:
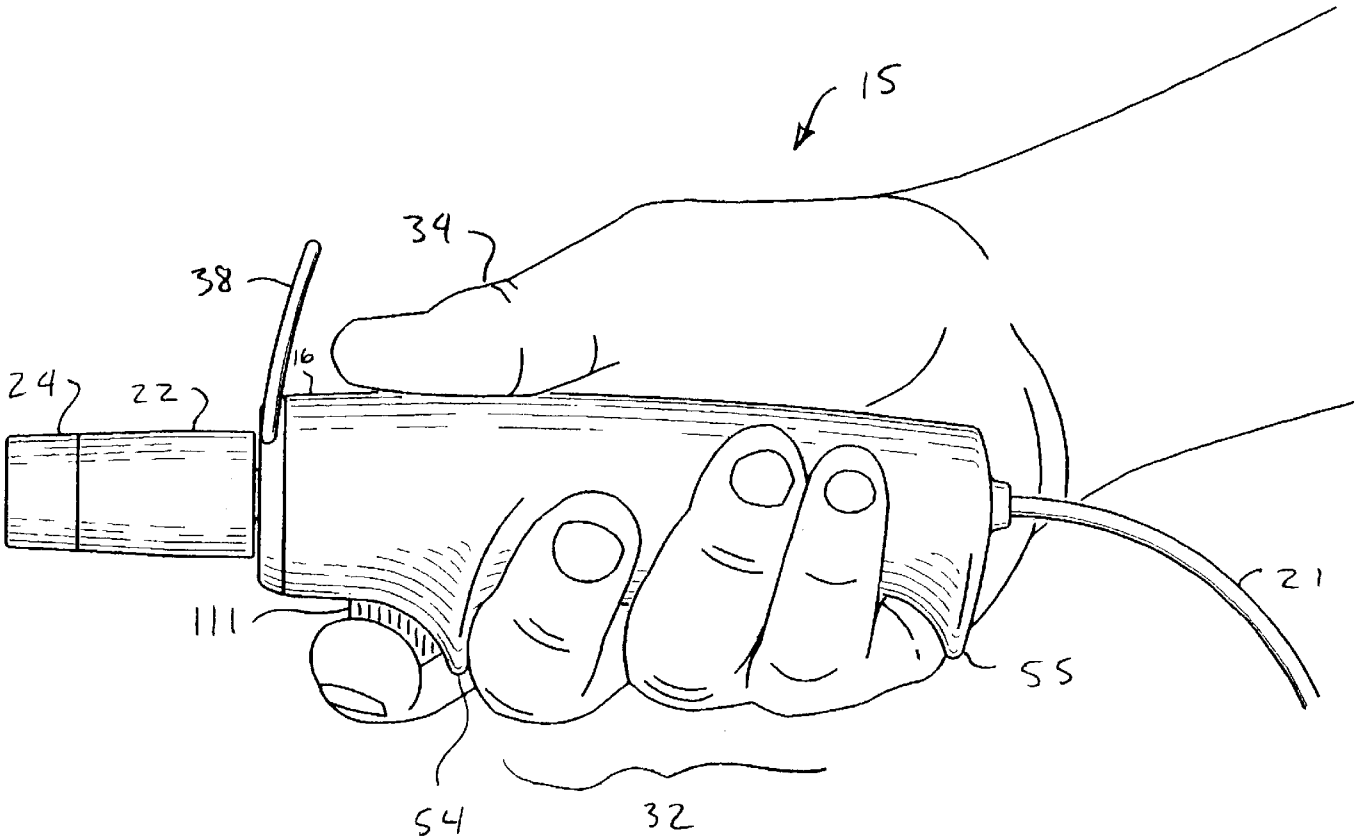
FIG. 25 is a side elevation view of an alternative embodiment of a hand-held starter apparatus showing a trigger coupled to a body and extending from the body adjacent a front ridge of the body.

Trigger switch 20 is preferably located behind starter motor 12 to minimize the diameter of forward body portion 30 adjacent to starter motor 20. Trigger 18 pivots about trigger pivot 19 and is automatically restored to an "off" position by a trigger spring 17. Trigger 18 generally extends from pivot 19 over starter motor 12 in a forward direction. Trigger 20 is configured to be actuated by the thumb 34 or palm 36 of the operator's hand. Depression of trigger 18 as by thumb 34 actuates button 13 on switch 20 and applies power to starter motor 12 to activate motor 12 causing shaft 11 to rotate about axis 14. Trigger 18 is curved upward with a radius of curvature 33 of about 3.5 inches to follow the natural curvature of lower surface 35 of thumb 34. Trigger pivot 19 is preferably located in rear body portion 32 to take advantage of the most natural hand motion to actuate trigger 18. Alternative embodiments, as shown for instance in FIG. 25, wherein a trigger in the form of a trigger button 111 is situated adjacent to or along front edge 52 of front ridge 54 to be actuated by finger 51 are within the scope of this disclosure.

Figure 3:
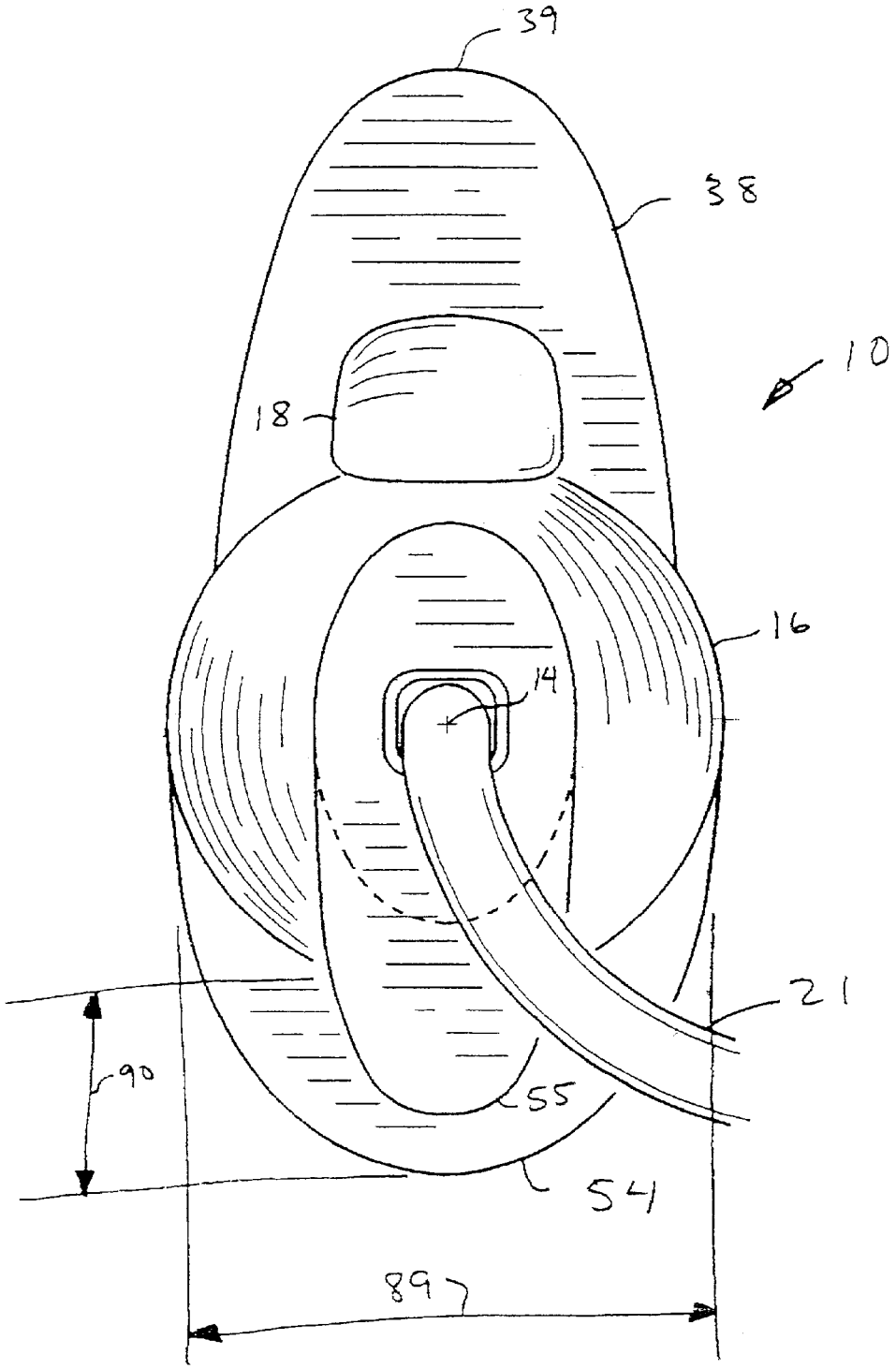
FIG. 3 is a rear elevation view of the starter apparatus of FIG. 2 showing that a rear portion of the body is oval in cross section and showing that a front portion of the body is circular in cross section.

Body 16 includes a forward body portion 30 which is generally circular in cross-section adjacent to starter motor 12 and a rear body portion 32 which is generally elliptical or oval in cross-section to accommodate the small fingers of the operator's hand. Forward portion 30 and rear body portion 32 blend together smoothly and thus, cooperate to provide body 16 with a main portion 30, 32 that extends between a front end 48 and a rear end 49 of body 16. Top profile 45, bottom profile 46 (FIG. 1) and side profiles 43, 44 (FIG. 2) of main portion 30, 32 are generally smoothly contoured to comfortably receive the operator's hand. As shown in FIG. 3, top profile 45 and bottom profile 46 blend smoothly into side profiles 43, 44 to comfortably receive the operator's hand.

Referring now to FIGS. 5–11, the shape of body 16 and profiles 43, 44, 45, and 46 are defined by cross sections taken along planes A–F that are each perpendicular to axis 14. Distance 75 between plane A and plane B is about 2.5 inches. Distance 76 between plane B and plane C, distance 77 between plane C and plane D, distance 78 between plane D and plane E, and distance 79 between plane E and plane F are all about 0.8 inches. When the word "about" is used in connection with any distance or dimension in the specification and in the claims, it is intended that a distance or dimension in a range of plus or minus 20 percent of the cited amount, (or an amount approximately equal to the size difference between a young female hand and an adult male hand), is covered literally, unless specifically noted otherwise. Thus, for example, the phrase "about 1 inch" literally covers distances or dimensions in the range of 0.8 inches to 1.2 inches and the phrase "about 4 inches" literally covers distances or dimensions in the range of 3.2 inches to 4.8 inches. Other ranges are intended to be covered equivalently, unless specifically noted otherwise.

Cross section A at front end 48 of body 16 is circular with height 56 of about 1.6 inches, width 57 of about 1.6 inches, and area of about 1.95 square inches. Cross sections B through E, are generally elliptical with cross section E being narrower than cross section B. Cross section B has height 60 of about 1.69 inches, width 61 of about 1.62 inches, and area of about 2.07 square inches. Cross section C has height 63 of about 1.65 inches, width 64 of about 1.47 inches, and area of about 1.46 square inches. Cross section D has height 66 of about 1.56 inches, width 67 of about 1.26 inches, and area of about 1.48 square inches. Cross section E has height 69 of about 1.43 inches, width 70 of about 1.0 inch, and area of about 1.10 square inches. Cross section F has height 72 of about 1.26 inches, width 73 of about 0.8 inches, and area of about 0.78 square inches.

The cross-sectional areas of cross sections E and F are only about one-half (53%) and one-third (38%), respectively, of the area of cross section B. The lower cross-sectional areas of sections C through F, and their smaller radiuses of curvature along bottom profile 46 accommodates the small ("pinky") and ring fingers of the operator's hand more comfortably and securely than conventional hand-held starters.

Main body portion 30, 32 is elongated and extends along a body axis that in some embodiments is parallel with axis 14 and that in the illustrative embodiment is coaxial with axis 14. Thus, in the illustrative embodiment, heights 56, 60, 63, 66, 69, 72 intersect the respective widths 57, 61, 64, 67, 70, 73 at axis 14.

Body 16 includes front ridge 54 and rear ridge 55 to axially position and support the operator's hand during operation of the electric starter. Front ridge 54 and rear ridge 55 are spaced apart to accommodate various hand sizes and hand grip configurations as discussed in detail below. Thus, a finger-receiving space is defined between front ridge 54 and rear ridge 55.

As shown in FIG. 1, a front portion 52 of front ridge 54 blends smoothly from a distal tip thereof into body portion 30 and is defined by a front arc having a forward face radius 82 of about 0.8 inches. A rear portion 85 of front ridge 54 blends smoothly from the distal tip thereof into body portion 30 and is defined by a second arc having a rear face radius 83 of about 0.39 inches. The center of the front arc from which radius 82 originates is forward of ridge 54 and the center of the second arc from which radius 83 originates is rearward of ridge 54. The centers from which radii 82, 83 originate are separated by an interfinger distance 84 of about 1.3 inches. Front ridge 54 is wide and deep enough to comfortably support a large portion of the pointer and index fingers of the operator's hand, and has a front ridge width 89 of about 1.66 inches and front ridge depth 90 of about 0.57 inches as shown in FIG. 3.

A front portion 87 of rear ridge 55 blends smoothly from a distal tip thereof into body portion 32 and is defined by an arc having a front face radius 86 of about 0.6 inches as shown in FIG. 1. The distal tip of rear ridge 55 is spaced apart from the distal tip of front ridge 54 by a ridge spacing 92 of about 4.1 inches. Rear ridge 55 preferably has a rear ridge depth 93 of about 0.51 inches. Rear ridge depth 93 can be extended to about 0.8 inches to provide greater support if desired.

Figure 4:
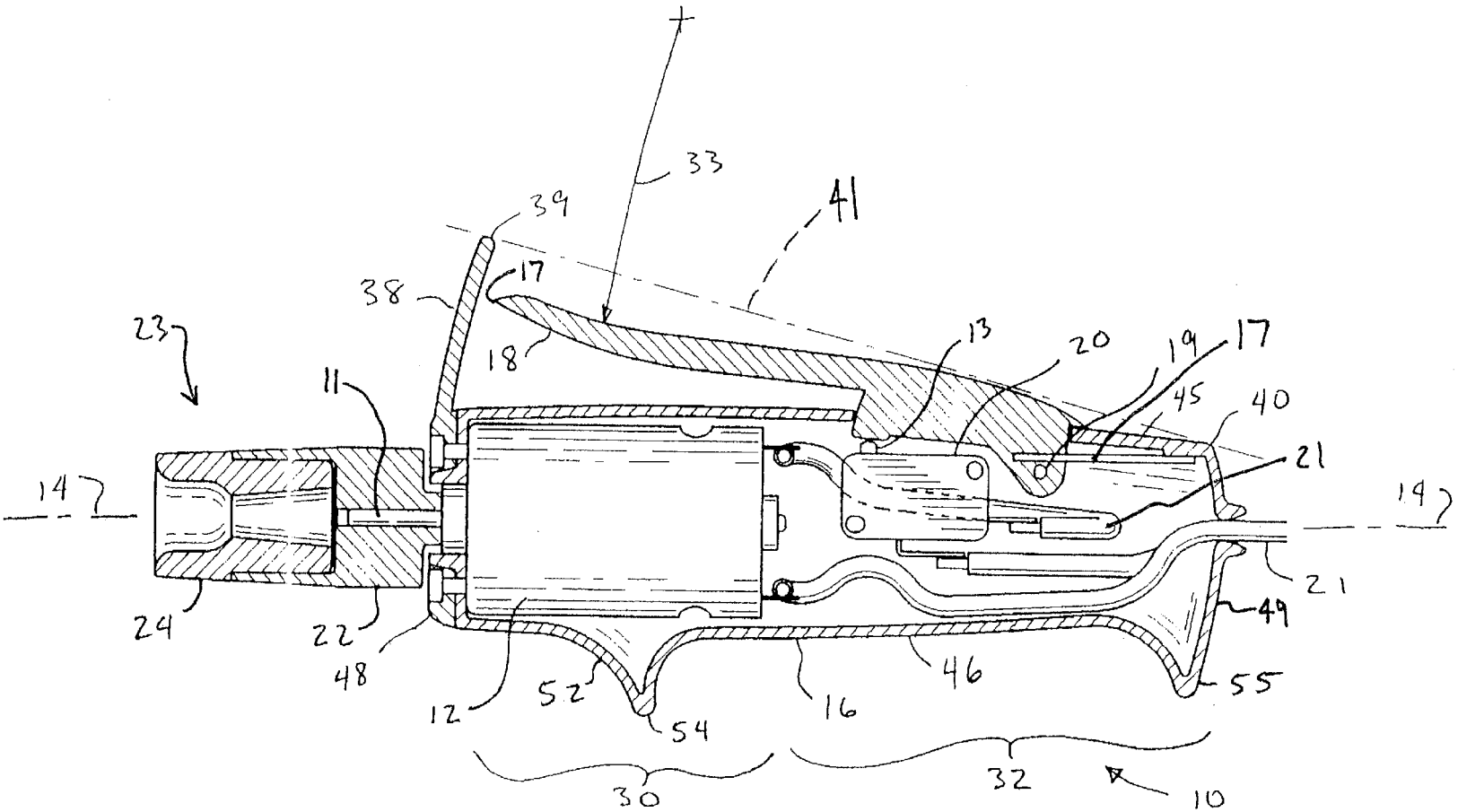
FIG. 4 is a cross sectional view of the starter apparatus of FIG. 1 showing a motor situated in an interior region of the body adjacent the front end of the body, the motor including a shaft to which the adapter assembly couples, a switch situated in the interior region between the motor and a rear end of the body, and the trigger including portions in the interior region of the body that interact with the switch.
Figure 5:
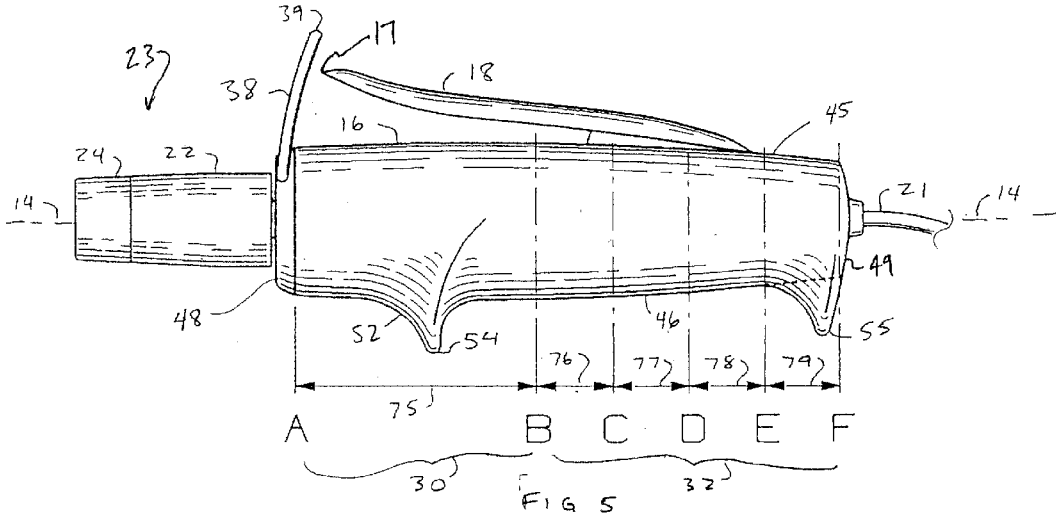
FIG. 5 is a side elevation view similar to FIG. 1 showing the relative positions of a plurality of planes (labeled A–F) through which cross sections are taken to show the variations in shape of an outer surface of the body between the front end and the rear end of the body.
Figure 6:
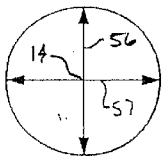
FIG. 6 is a cross sectional view taken along plane A of FIG. 5 showing the outer surface having a substantially circular shape adjacent the front end of the body.
Figure 7:
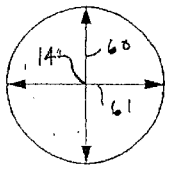
FIG. 7 is a cross sectional view taken along plane B of FIG. 5 showing the outer surface having a somewhat circular shape, but slightly out of round, at a middle region of the body that is closer to the front end than the rear end.
Figure 8:
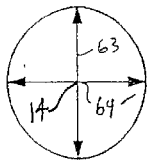
FIG. 8 is a cross sectional view taken along plane C of FIG. 5 showing the outer surface having a slightly elliptical or oval shape at a middle region of the body that is closer to the rear end than the front end.
Figure 9:
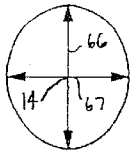
FIG. 9 is a cross sectional view taken along plane D of FIG. 5 showing the outer surface having a substantially elliptical or oval shape at a region of the body that is closer to the rear end than the region of the body shown in FIG. 8.
Figure 10:
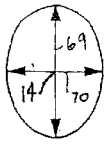
FIG. 10 is a cross sectional view taken along plane E of FIG. 5 showing the outer surface having a substantially elliptical or oval shape at a region of the body that is closer to the rear end than the region of the body shown in FIG. 9.
Figure 11:
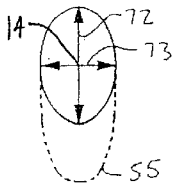
FIG. 11 is a cross sectional view taken along plane F of FIG. 5 showing the outer surface having a substantially elliptical or oval shape adjacent the rear end of the body.

As shown, for example, in FIGS. 4 and 5, body 16 includes a front guard 38 that extends away from body portion 30 adjacent front end 48 of body 16. A distal tip 17 of trigger 18 is spaced apart from and confronts front guard 38. Thus, front guard 38 is positioned to lie between adapter assembly 23 and trigger 18 to act as a shield that prevents thumb 34 from extending or slipping in front of body 16 thereby reducing the possibility that thumb 34 will come into contact with model engine 28 or anything attached thereto such as propeller 29 of a model airplane (not shown). Tip 39 of front guard 38 and rear top corner 40 of body 16 form roll line 41 as shown in FIG. 4. Roll line 41 is, at all points, above trigger 18 thereby preventing accidental depression of trigger 18 if starter apparatus 10 is placed on or rolled on the ground or other hard, flat surface after use.

The small size, unique cross sections and special front ridge 54 and rear ridge 55 of starter apparatus 10 support a variety of hand grip configurations as shown in FIG. 12 through FIG. 16. Hand grip configurations are described herein as "standard", "alternative", "relaxed", "extended" and "palm" depending upon the finger configuration of the grip. Other grip configurations are possible, but are not shown.

Figure 12:
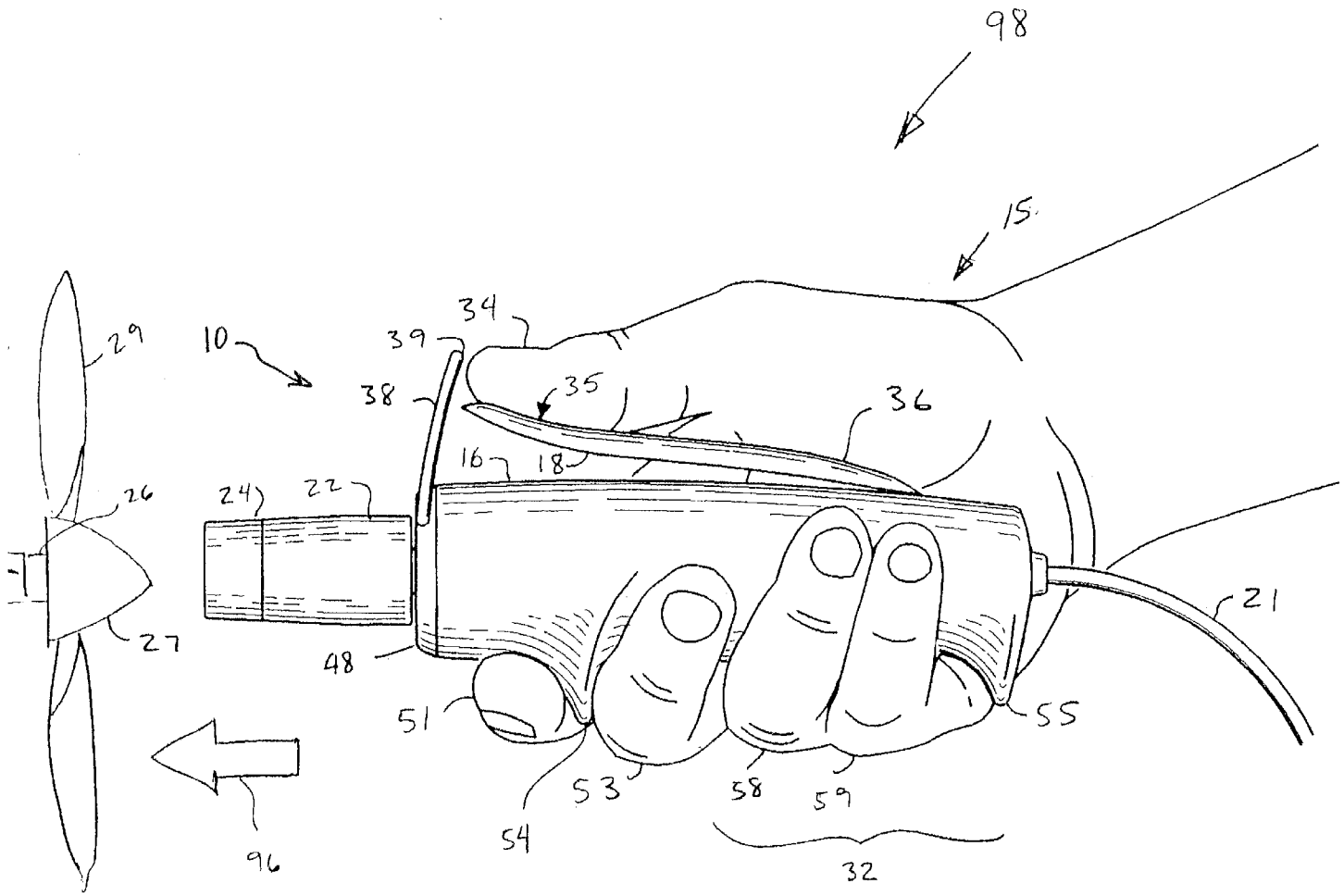
FIG. 12 is a side elevation view similar to FIG. 1 showing an operator holding the body of the starter apparatus with a standard grip and orienting the starter apparatus in a position having the adapter assembly in alignment with a propeller spinner of a model airplane.

FIG. 12 shows standard grip 98 having large hand 15 axially positioned by front ridge 54 between pointer finger 51 and index finger 53. Standard grip 98 provides great forward thrust capability. Tapered rear portion 32 of body 16 allows ring finger 58 and small finger 59 to close on body 16 more than pointer finger 51 and index finger 53, and improves the ability of the operator to apply axial force in direction 96 to body 16 without hand 15 slipping axially. Thumb 34 rests comfortably against trigger 18 with little or no force thereby reducing the possibility of accidental operation of trigger 18.

Figure 13:
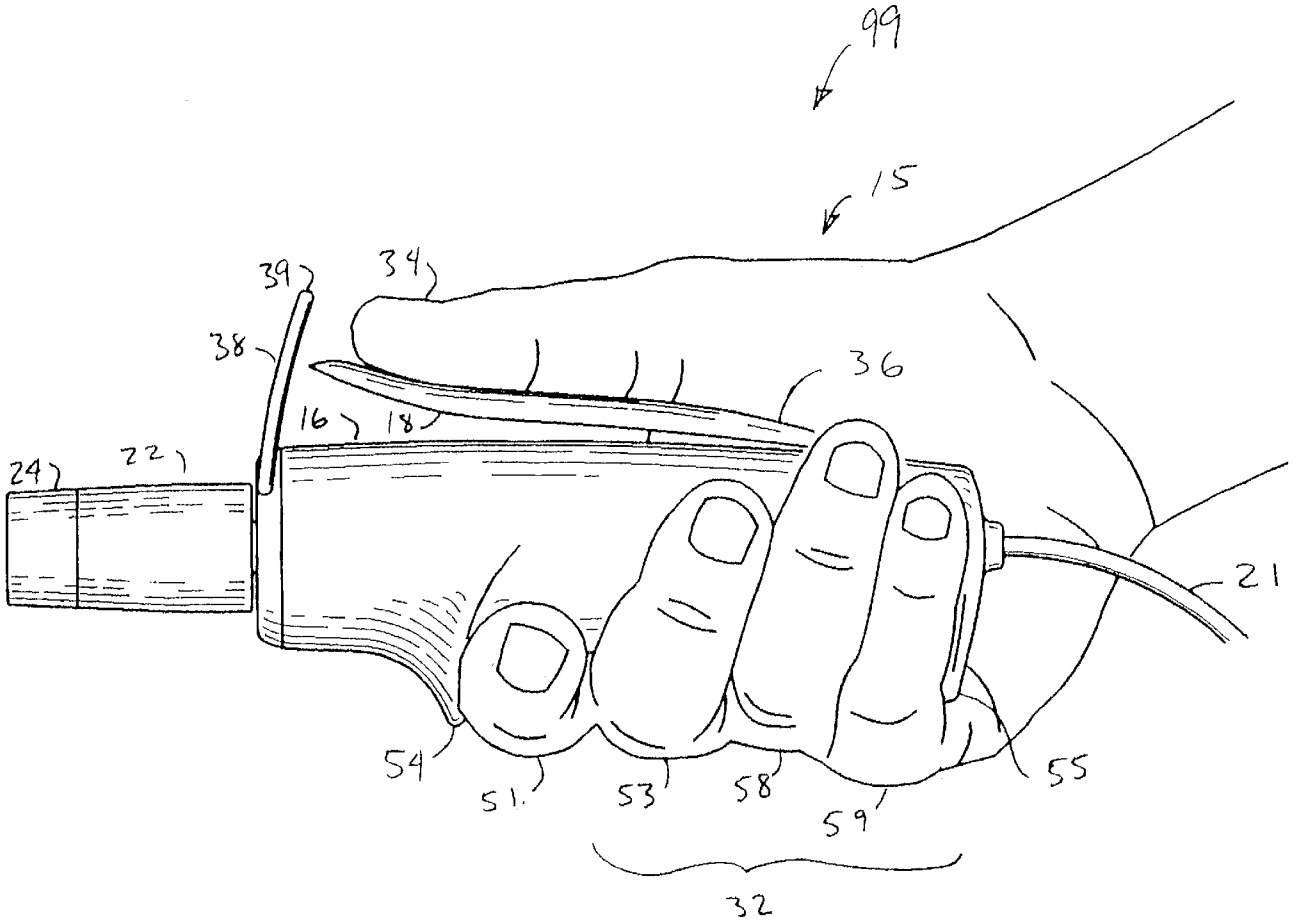
FIG. 13 is a side elevation view similar to FIG. 12 showing the operator holding the body of the starter apparatus with an alternative grip.

Alternative grip 99 shown in FIG. 13 has fingers 51, 53, 58 and 59 positioned between front ridge 54 and rear ridge 55. Ring finger 58 and small finger 59 can close more completely around rear body portion 32 which is more comfortable for some operators.

Figure 14:
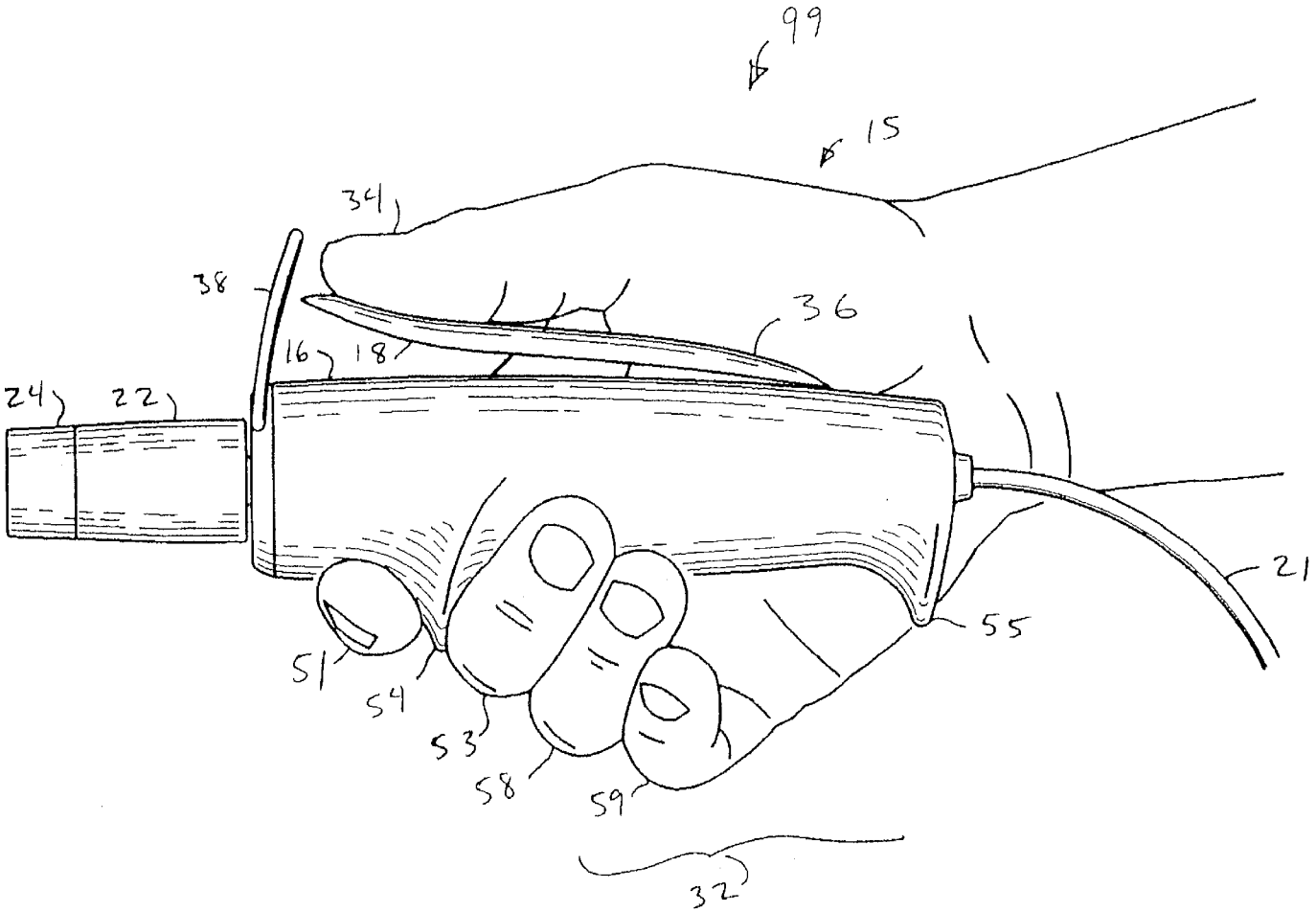
FIG. 14 is a side elevation view similar to FIG. 13 showing the operator holding the body of the starter apparatus with a relaxed grip.

Relaxed grip 100 is shown in FIG. 14 where large hand 15 is again axially positioned by front ridge 54 between pointer finger 51 and index finger 53 of large hand 15, but without ring finger 58 or small finger 59 engaging body 16. Relaxed grip 99 provides delicate control of axial force which can, for instance, reduce the possibly of damage to model airplanes (not shown) which must be lightly constructed to fly well.

Figure 15:
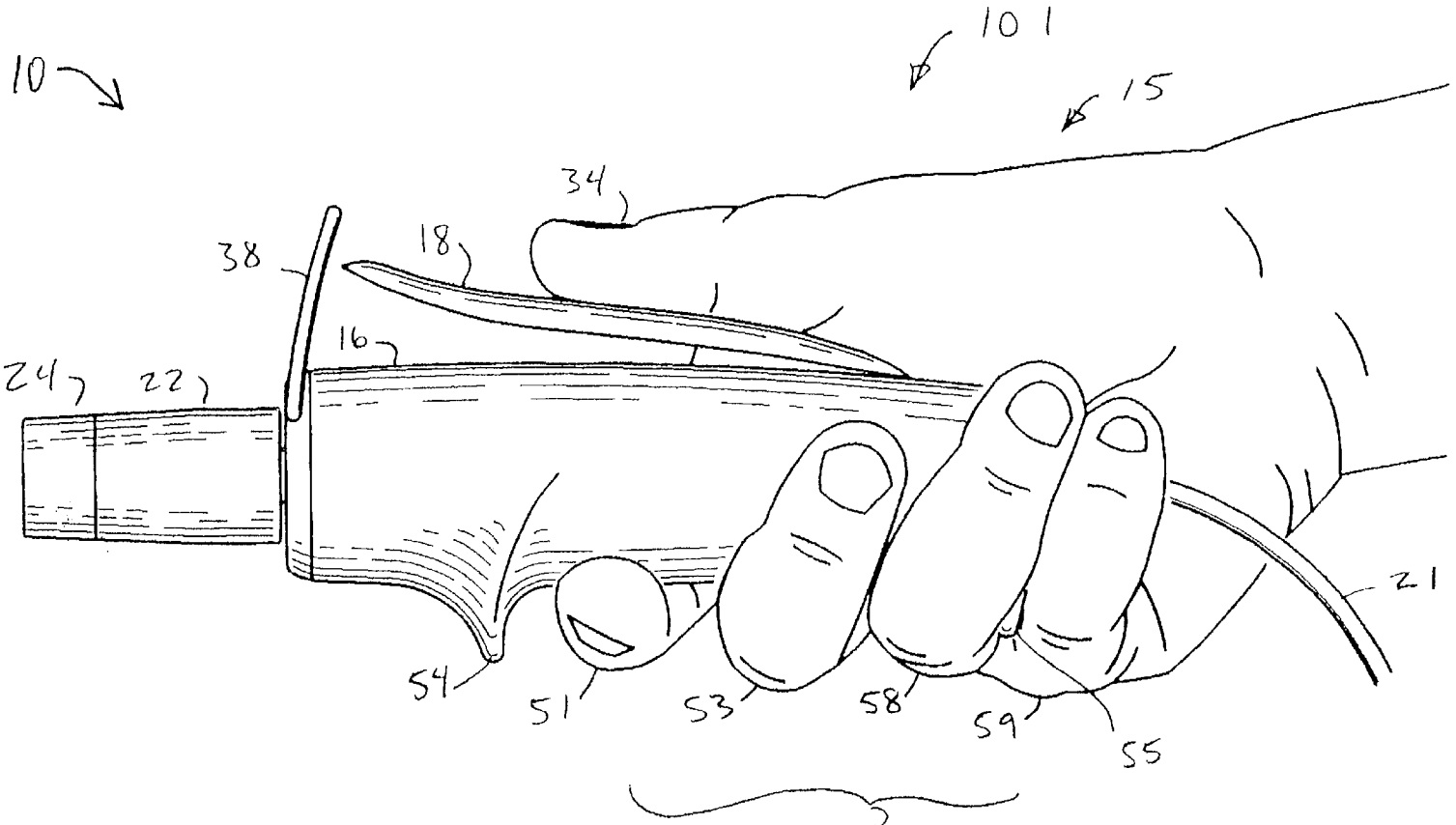
FIG. 15 is a side elevation view similar to FIG. 14 showing the operator holding the body of the starter apparatus with an extended grip.

Extended grip 101 is shown in FIG. 15 where operation of starter 10 is extended by hand 15 gripping rear portion of body 32 with rear ridge 55 situated between ring finger 58 and little finger 59. Rear ridge 55 prevents hand 15 from slipping axially along body 16. Trigger 18 is long enough to be actuated by thumb 34 even in the extended position. Extended grip 101 is advantageous, for instance, in applications where the engine being started is obstructed by a portion of the model such as in model helicopter applications where the engine is embedded deeply within the model helicopter fuselage (not shown).

Figure 16:
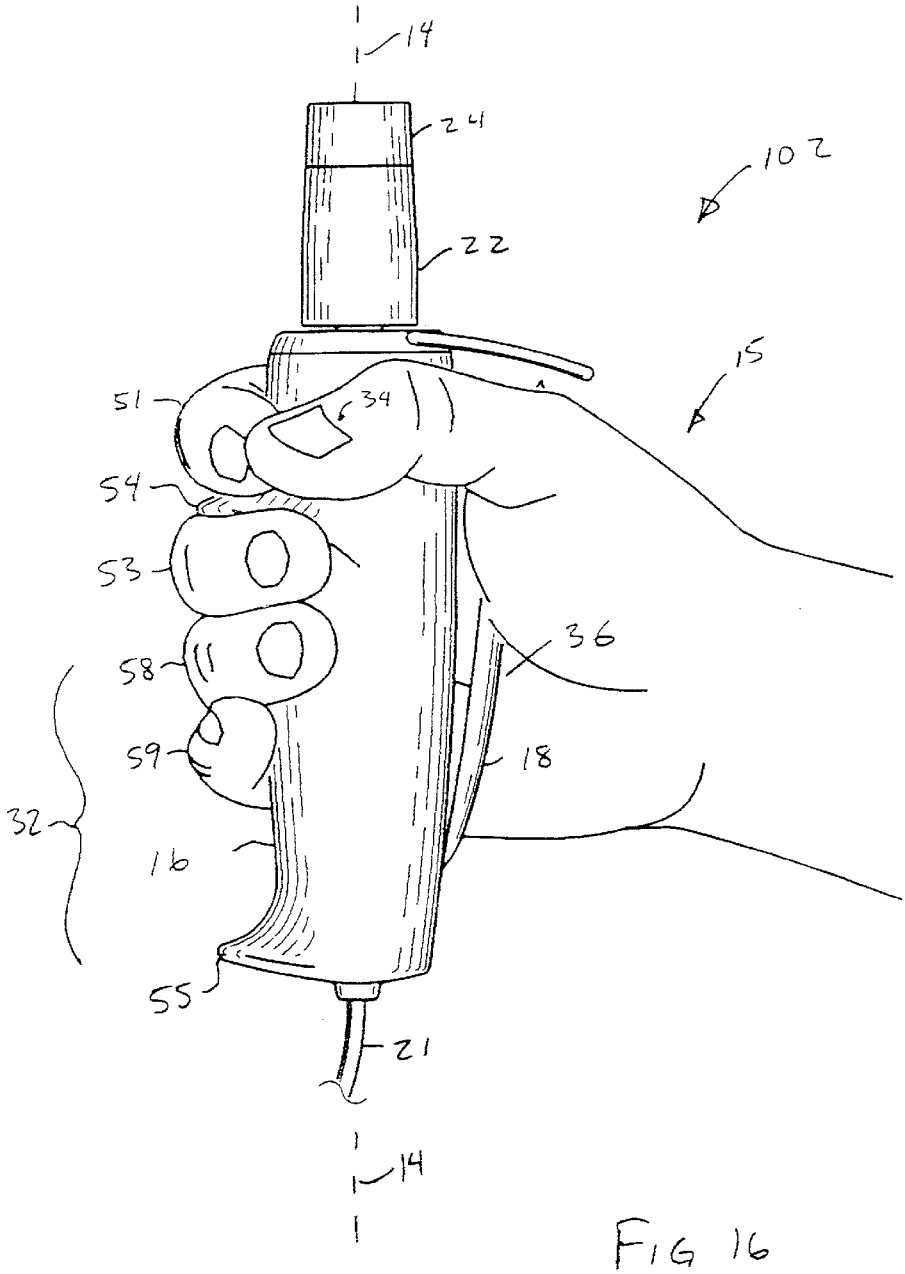
FIG. 16 is a side elevation view similar to FIG. 15 showing the starter apparatus in a vertical orientation and showing the operator holding the body of the starter apparatus with a palm grip.

Palm grip 102 is shown in FIG. 16 where trigger 16 is being actuated by palm 36 of hand 15. Front ridge 54 prevents starter apparatus 10 from slipping axially out of hand 15. Palm grip 102 allows the operator's arm (not shown) to comfortably extend at a right angle to axis 14 of starter motor 12 when starting a model airplane which is sitting on the ground while simultaneously holding the model airplane with the other hand.

As illustrated in FIGS. 13–16, front ridge 54 and rear ridge 55 cooperate to form a finger-receiving space which receives one or more of the operator's fingers. Thus, ridges 54, 55 facilitate the axial positioning of the operator's hand 15 and also serve to support hand 15 in the standard configuration, shown in FIG. 13, and in the alternative grip configurations, shown in FIGS. 14–16. In addition, front ridge 54 and rear ridge 55 each cooperate independently with trigger 18 to allow various hand grip configurations without impairing the triggering function of starter apparatus 10.

Figure 18:
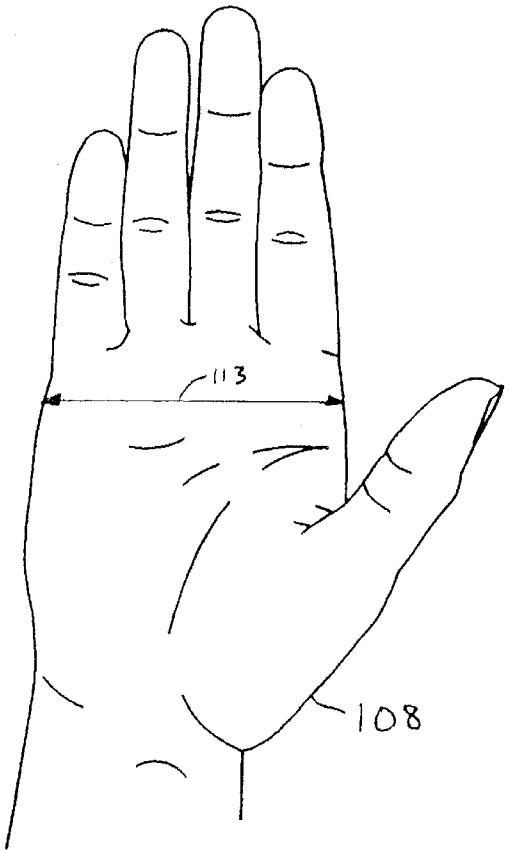
FIG. 18 is a diagrammatic view of a palm and fingers of a small hand showing the width of the small hand across the palm.
Figure 17:
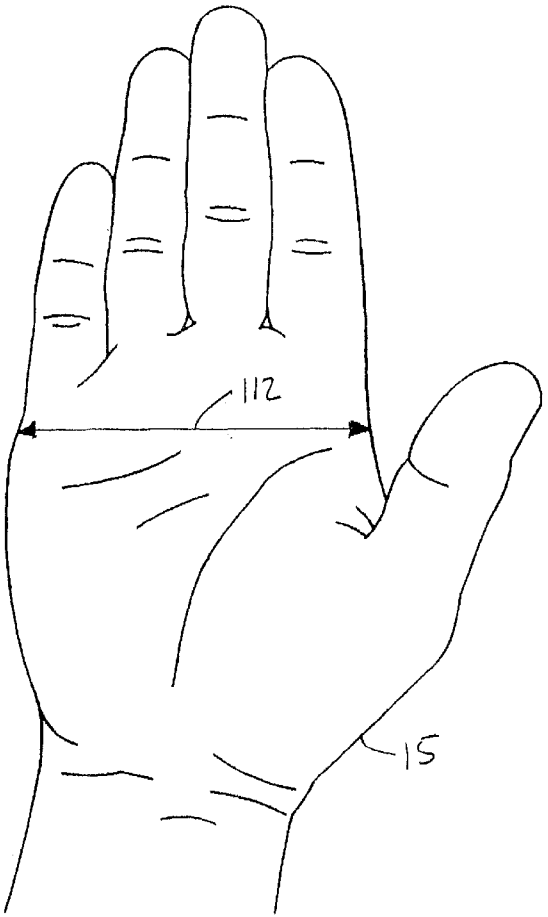
FIG. 17 is a diagrammatic view of a palm and fingers of a large hand showing the width of the large hand across the palm.

Body 16 of starter apparatus 10 is designed to accommodate hands of varying sizes. FIG. 17 illustrates the size of large hand 15 which has a large hand width 112 of about 3.8 inches (adult male) and FIG. 18 illustrates a small hand 108 which has a small hand width 113 of about 2.8 inches (young female). The young female hand 108 is roughly 40% smaller than the adult male hand.

Figure 19:
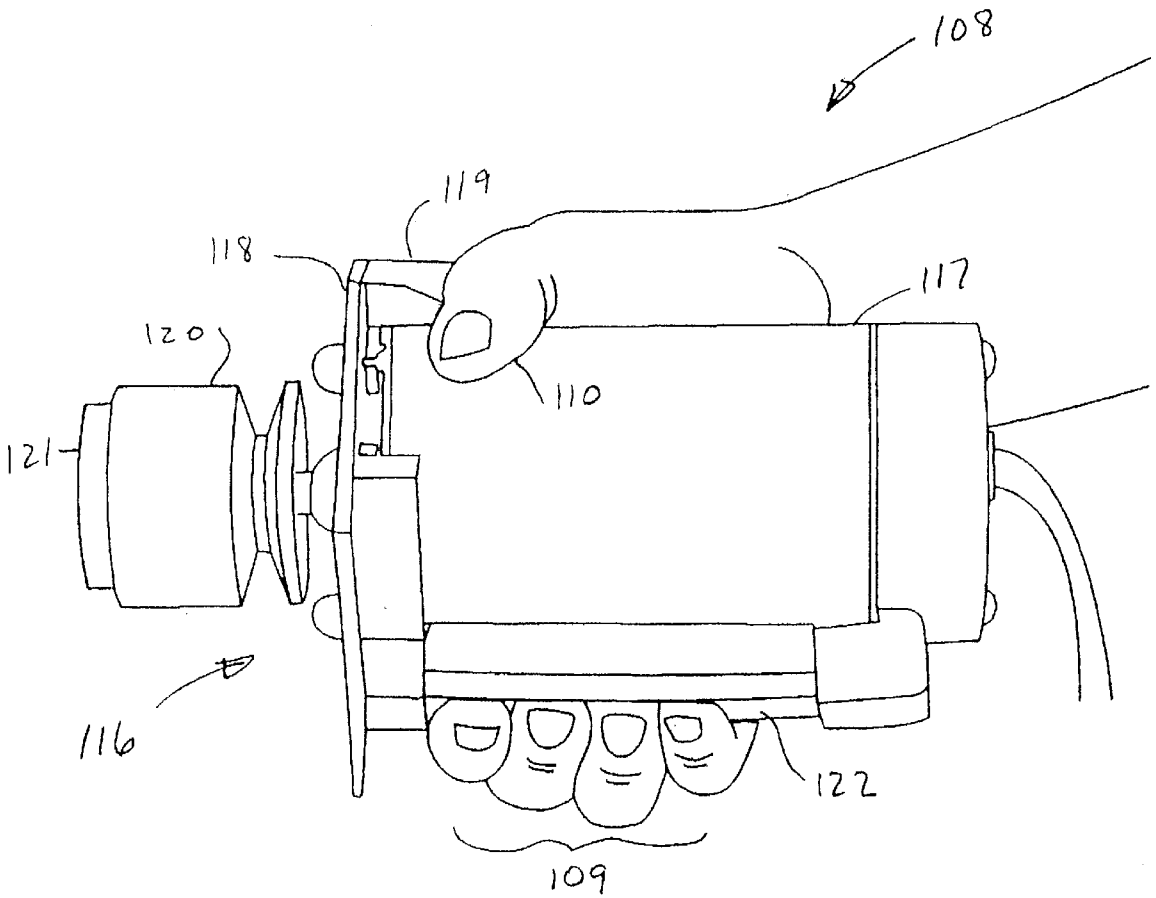
FIG 19 PRIOR ART
FIG. 19 is a side elevation view of a first side of a prior art electric starter showing the prior art starter motor having a large outside diameter and showing an operator with small hands holding the prior art starter motor.
Figure 20:
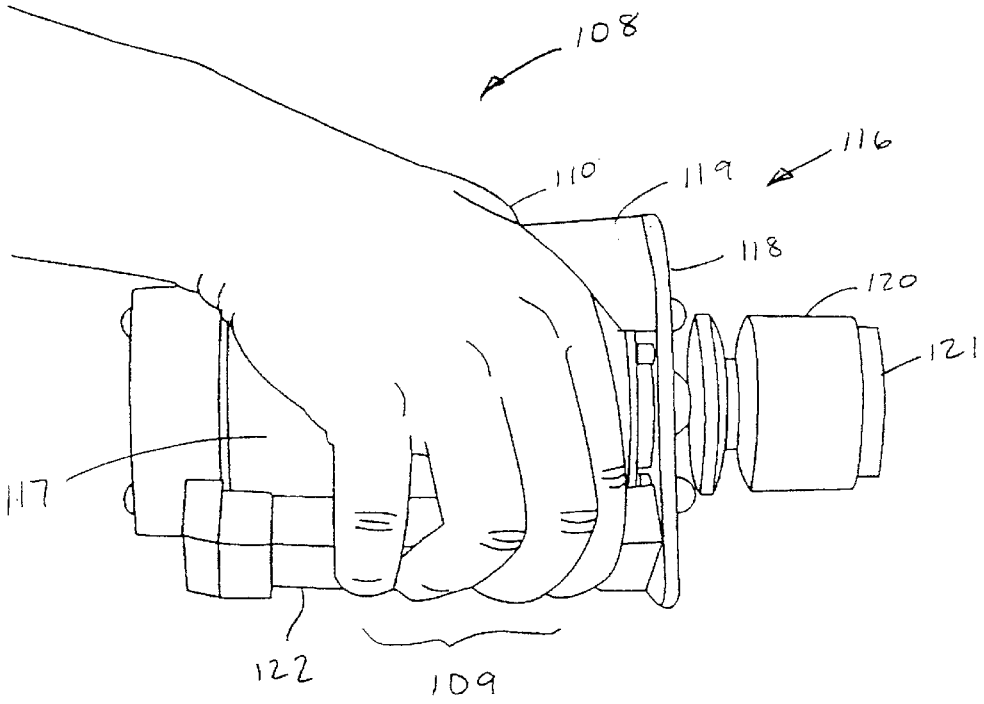
FIG 20 PRIOR ART
FIG. 20 is a side elevation view of a second side of the prior art electric starter of FIG. 19.

FIGS. 19 and 20 show a commercially available Sullivan-brand electric starter 116 model "600 Hi-Tork" having a cylindrical body 117, front cap 118, hand rest 119, adapter hub 120 and elastomeric coupling adapter 121 and held by small hand 108. The large diameter of body 117 prevents the operator from completely closing fingers 109 on body 117 so fingers 109 must support starter 116 through trigger 122. This can be awkward and can result in accidental operation of trigger 122. Axial loads are carried by hand rest 119 on front cap 118 situated between thumb 110 and fingers 109.

Figure 21:
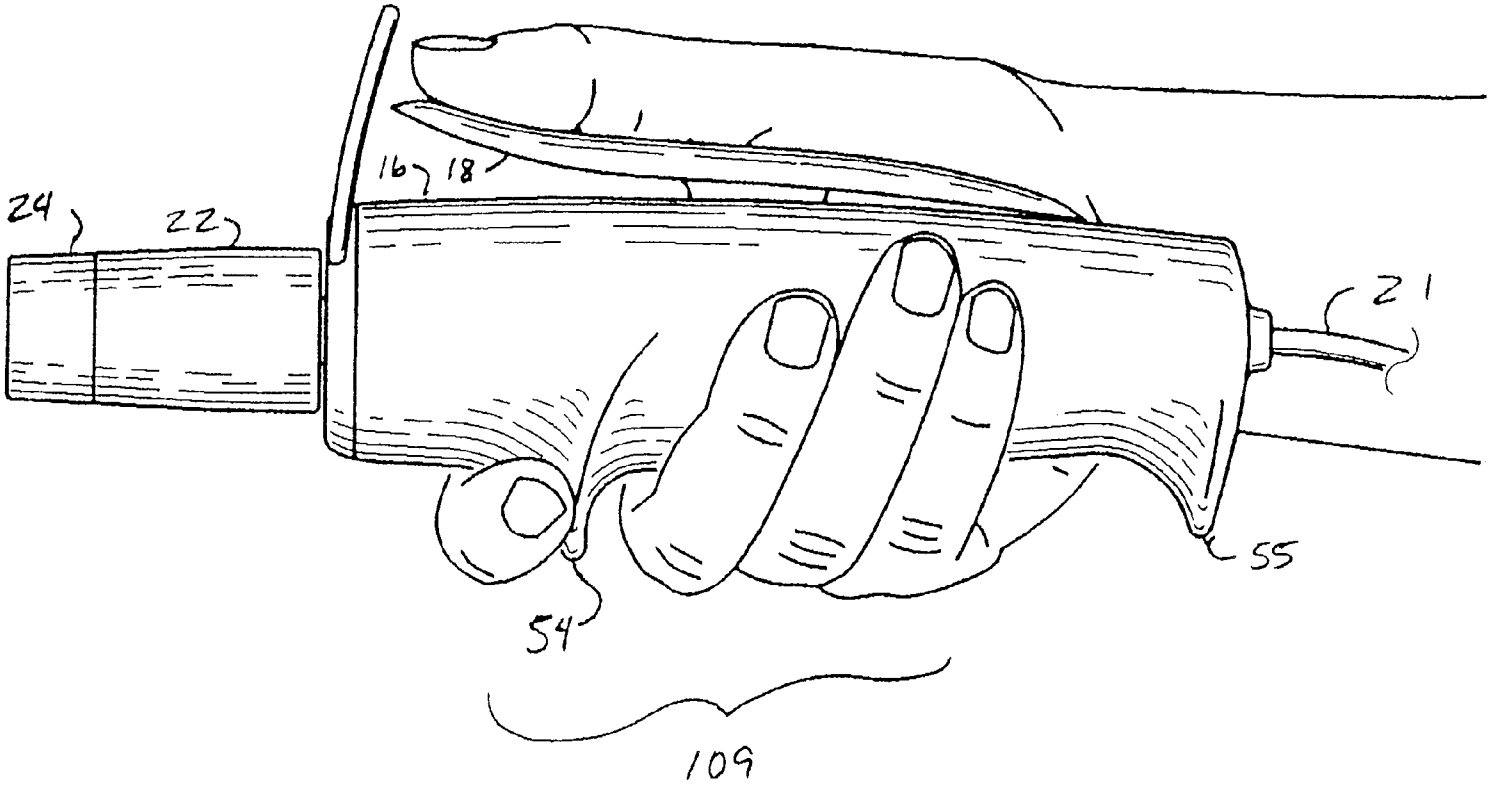
FIG. 21 is a side elevation view similar to FIG. 12 showing an operator having small hands holding the preferred starter apparatus with the standard grip.
Figure 22:
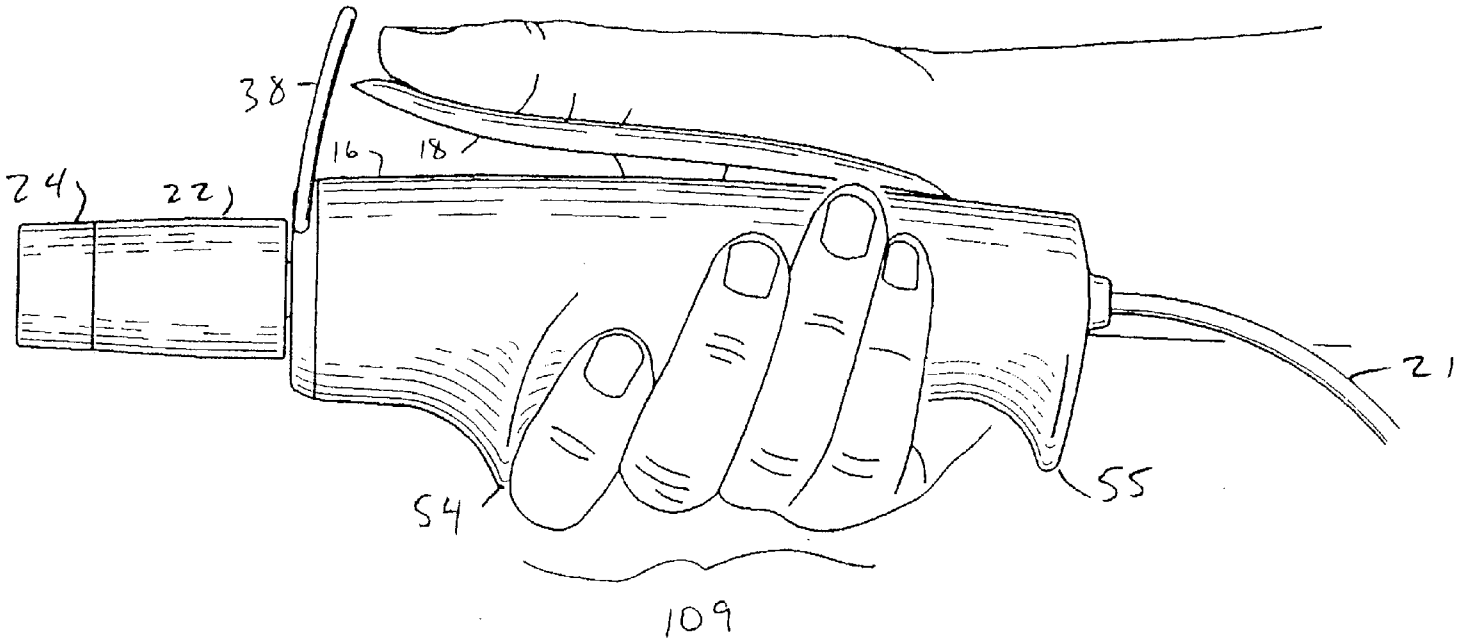
FIG. 22 is a side elevation view similar to FIG. 21 showing the operator having small hands holding the starter apparatus with the alternative grip.

In contrast, FIGS. 21 and 22 show small hand 108 comfortably gripping starter apparatus 10. Fingers 109 can close more completely on body 16 than can the same fingers on motor case 117 of starter 116 shown in FIGS. 19 and 20. Thus, the shape of body 16 is configured so that a user having small hands is able to grip starter apparatus 10 more firmly and more comfortably than the user is able to grip prior art starter 116.

Figure 23:
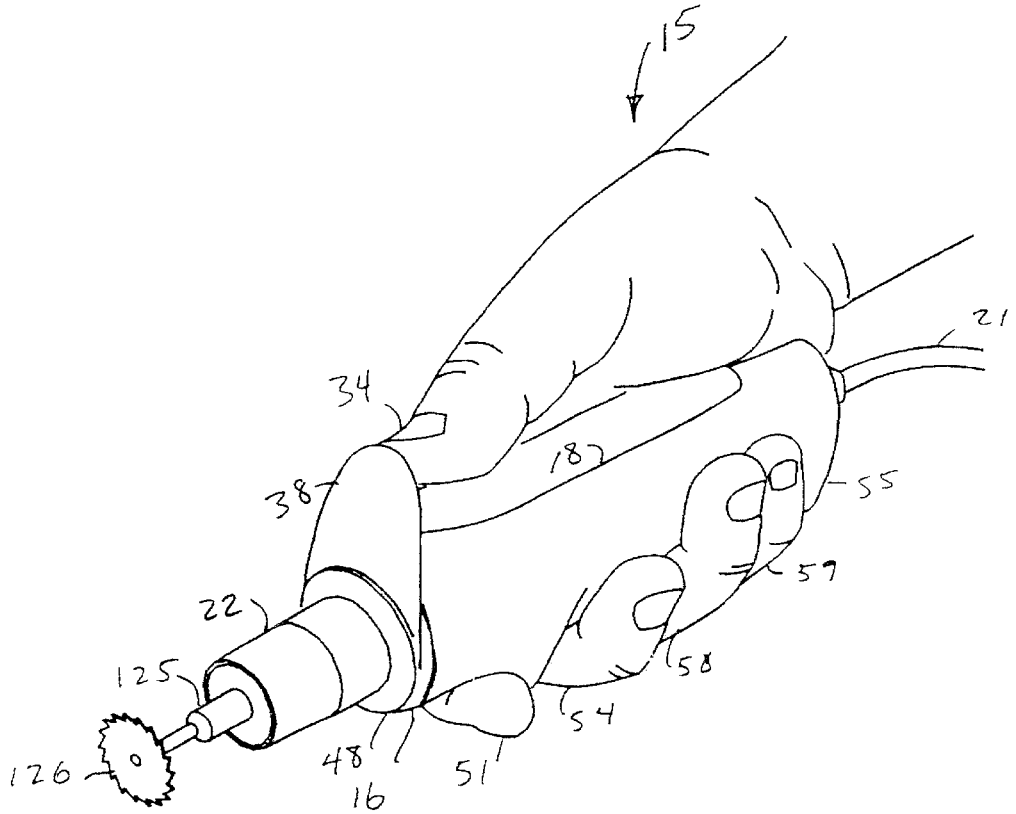
FIG. 23 is a perspective view of the starter apparatus of FIG. 1 showing a rotary cutting tool coupled to the adapter assembly.
Figure 29:
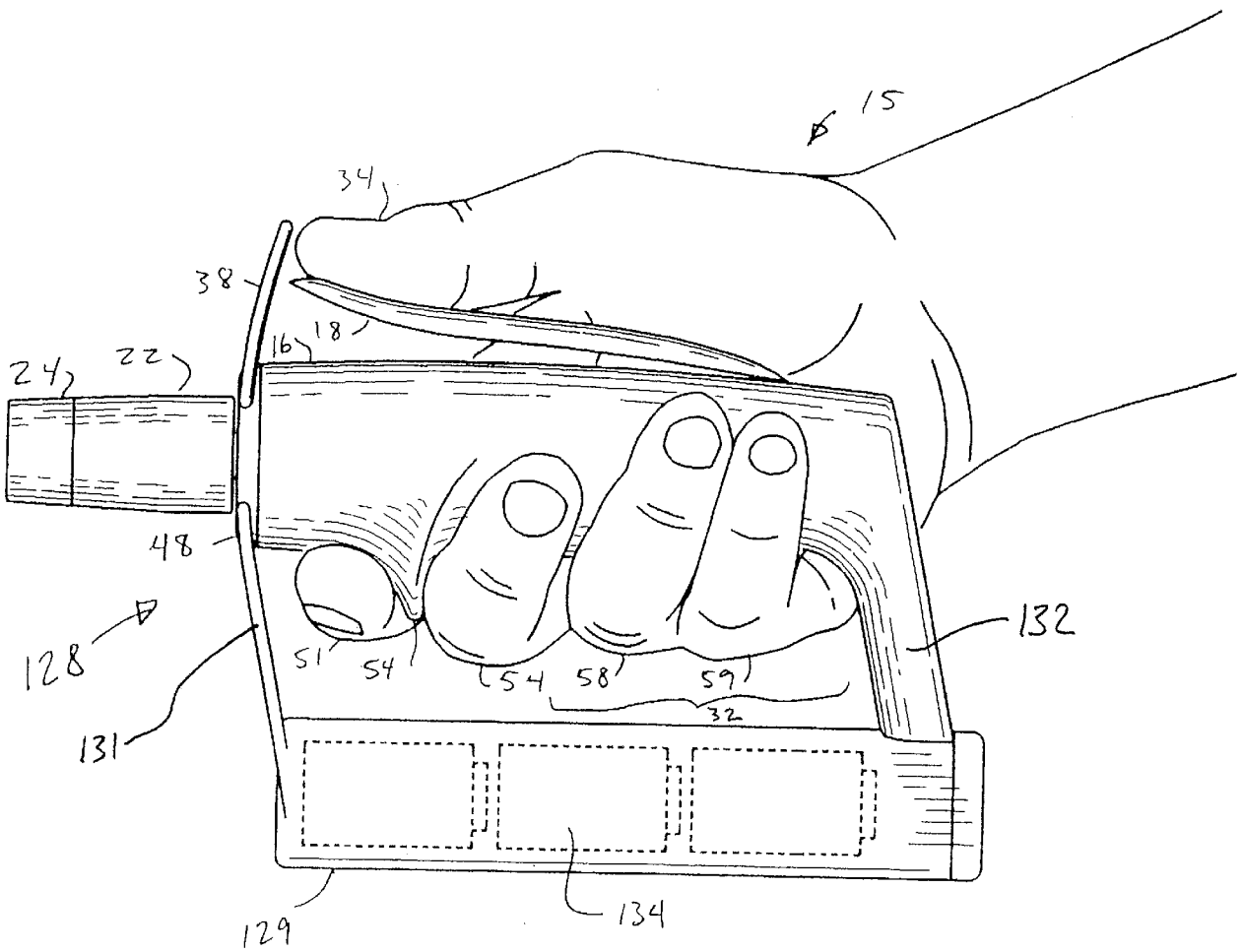

Referring now to FIG. 23, a tool chuck adapter 125 is coupled to adapter hub 22 in place of coupling adapter 24. A saw blade 126 is coupled to tool chuck adapter 125 to rotate therewith. Other types of tools such as grinders, reamers, deburrers, and the like may be coupled to tool chuck adapter 125 in lieu of saw blade 126. Thus, a variety of tools may be coupled to starter apparatus 10. Such tools may be of the type suitable for general maintenance of a model at a flying field or model park where the a model is being operated. The dual use of apparatus 10 as a starter and as a hand tool allows the operator to perform maintenance away from home without bringing extra power tools or source of power to the model park.

Adapter hub 22 is adapted to receive and securely hold tool chuck adapter 125. In a preferred embodiment, tool chuck adapter 125 is retained by adapted hub 22 by use of a snap fit connection between tool chuck adapter 125 and adapter hub 22 so that tool chuck adapter 125 may be inserted and removed from adapter hub 22 by hand without the need to use other tools.

Starter apparatus 10 may be powered in many ways including by electric power as from a battery. Battery connections can be made by long wires 21 to the terminals of a power cell such as a 12 volt automobile battery (not shown). An alternative embodiment starter apparatus 128 is shown in FIG. 24. Portable starter 128 includes a power pack 129 supported below body 16 by a forward battery brace 131 appended to front end 48 of body 16 and by a rear electric-wire conduit 132 appended to rear body portion 32. Power pack 129 houses a widely available six-cell, 7.2 volt NiCad or nickel metal hydride battery pack 134 or similar battery packs commonly used in radio-controlled cars. Wires (not shown) extend through conduit 132 to supply motor 12 with power from battery pack 134. Thus, starter apparatus 128 is portable and self-contained allowing the operator greater freedom of motion than do embodiments with long battery wires that couple to remote sources of power.

In alternative embodiments (not shown), rear end 49 of body 16 is extended rearwardly along axis 14 to accommodate and enclose a battery power pack, such as power pack 129, instead of supporting power pack 129 below body 16 in the manner shown in FIG. 24. Such alternative embodiments are easier to hold in a vertical orientation (with axis 14 vertical to the ground) when starting a model helicopter engine such as the engine of a Model 110 helicopter manufactured by Lite Machines Corporation of West Lafayette, Ind.

Although the invention has been described in detail with reference to certain preferred embodiments, variations and modifications exist within the scope and spirit of the invention as described and defined in the following claims.

What is claimed is:

1. A hand-held starter apparatus for starting model engines, the apparatus comprising a motor including a shaft that is rotatable about a motor axis, a trigger coupled to the motor to activate the motor to rotate the shaft to start a model engine, and a body having an interior region in which at least a portion of the motor is situated, the body being configured to be hand held, the body having a front end and a rear end, the body including an elongated main portion extending between the front end and the rear end, the elongated main portion having a body axis, the body including a front ridge extending from the elongated main portion, the front ridge being spaced apart from the front end, the front ridge being adapted for receipt between the pointer and index fingers of an operator's hand.

2. A hand-held starter apparatus for starting model engines, the apparatus comprising a motor including a shaft that is rotatable about a motor axis, a trigger coupled to the motor to activate the motor to rotate the shaft to start a model engine, and a body having an interior region in which at least a portion of the motor is situated, the body being configured to be hand held, the body having a front end and a rear end, the body including an elongated main portion extending between the front end and the rear end, the elongated main portion having a body axis, the body including a front ridge extending from the elongated main portion, the front ridge being spaced apart from the front end, a rear ridge extending from the elongated main portion and the rear ridge being spaced apart form the front ridge to define a finger-receiving space therebetween, the rear ridge including a rear distal tip spaced apart from the elongated main portion, the rear ridge blending smoothly with the elongated main portion from the rear distal tip along an arc having a radius positioned to lie forward of the rear distal tip.

3. The apparatus of claim 2, wherein the radius is about 0.6 inches.

4. A hand-held starter apparatus for starting model engines, the apparatus comprising a motor including a shaft that is rotatable about a motor axis, a trigger coupled to the motor to activate the motor to rotate the shaft to start a model engine, and a body having an interior region in which at least a portion of the motor is situated, the body being configured to be hand held, the body having a front end and a rear end, the body including an elongated main portion extending between the front end and the rear end, the elongated main portion having a body axis, the body including a front ridge extending from the elongated main portion, the front ridge being spaced apart from the front end, the trigger being coupled to the elongated main portion for pivoting movement about a trigger axis that is perpendicular to and spaced apart from the body axis and the trigger axis being positioned to lie between the rear end and the front end.

5. The apparatus of claim 4, wherein the trigger axis is closer to the rear end of the body than the front end of the body.

6. The apparatus of claim 4, wherein the body includes a front guard extending away from the elongated main portion adjacent the front end of the body, the trigger includes a distal end spaced apart from the trigger axis, and the distal end of the trigger confronts the front guard.

7. The apparatus of claim 6, wherein the elongated main portion and the front guard are configured so that as the apparatus is rolled on a flat surface, no portion of the flat surface contacts the trigger.

8. The apparatus of claim 4, wherein the trigger includes a hand-engaging surface that faces away from the body, at least a portion of the hand-engaging surface curves along an arc having a radius of about 3.5 inches.

9. A hand-held starter apparatus for starting model engines, the apparatus comprising a motor including a shaft that is rotatable about a motor axis, a trigger coupled to the motor to activate the motor to rotate the shaft to start a model engine, and a body having an interior region in which at least a portion of the motor is situated, the body being configured to be hand held, the body having a front end and a rear end, the body including an elongated main portion extending between the front end and the rear end, the elongated main portion having a body axis, the body including a front ridge extending from the elongated main portion, the front ridge being spaced apart from the front end, a front portion of the elongated main portion adjacent the front end of the body having a substantially round cross section along a first plane that is perpendicular to the body axis and a rear portion of the elongated main portion adjacent the rear end of the body having a substantially elliptical cross section along a second plane that is perpendicular to the body axis.

10. A hand-held starter apparatus for starting model engines, the apparatus comprising a motor including a shaft that is rotatable about a motor axis, a trigger coupled to the motor to activate the motor to rotate the shaft to start a model engine, and a body having an interior region in which at least a portion of the motor is situated, the body being configured to be hand held, the body having a front end and a rear end, the body including an elongated main portion extending between the front end and the rear end, the elongated main portion having a body axis, the body including a front ridge extending from the elongated main portion, the front ridge being spaced apart from the front end, the body having a plurality of cross sections taken through the elongated main portion between the front end of the body and the rear end of the body that transition smoothly from being mostly round in a forward body portion of the elongated main portion adjacent the front end of the body to being mostly elliptical in a rear body portion of the elongated main portion adjacent the rear end of the body and each cross section of the plurality of cross sections being taken along a corresponding plane that is perpendicular to the body axis.

11. A hand-held starter apparatus for starting model engines, the apparatus comprising a motor including a shaft that is rotatable about a motor axis, a trigger coupled to the motor to activate the motor to rotate the shaft to start a model engine, and a body having an interior region in which at least a portion of the motor is situated, the body being configured to be hand held, the body having a front end and a rear end, the body including an elongated main portion extending between the front end and the rear end, the elongated main portion having a body axis, the body including a front ridge extending from the elongated main portion, the front ridge being spaced apart from the front end, the front ridge including a front distal tip spaced apart from the elongated main portion, the front ridge blending smoothly with the elongated main portion from the front distal tip along a first arc having a first radius positioned to lie forward of the front distal tip, and the front ridge blending smoothly with the elongated main portion from the front distal tip along a second arc having a second radius positioned to lie rearward of the front distal tip.

12. The apparatus of claim 11, wherein the first radius is longer than the second radius.

13. The apparatus of claim 11, wherein the first radius is about twice as long as the second radius.

14. The apparatus of claim 11, wherein the first radius is about 0.8 inches and the second radius is about 0.4 inches.

15. The apparatus of claim 11, wherein a center of the first arc is spaced apart from a center of the second arc by about 1.3 inches.

16. The apparatus of claim 11, further comprising a rear ridge extending from the elongated main portion, the rear ridge being spaced apart form the front ridge to define a finger-receiving space therebetween, the rear ridge including a rear distal tip spaced apart from the elongated main portion, the rear ridge blending smoothly with the elongated main portion from the rear distal tip along a third arc having a third radius positioned to lie forward of the rear distal tip.

17. The apparatus of claim 16, wherein the first radius is longer than the third radius and the second radius is shorter than the third radius.

18. The apparatus of claim 16, wherein the third radius is approximately a mean of a sum of the first radius and the second radius.

19. The apparatus of claim 16, wherein the first radius is about 0.8 inches, the second radius is about 0.4 inches, and the third radius is about 0.6 inches.

20. The apparatus of claim 16, wherein the front distal tip is spaced apart from the rear distal tip by a distance of about 4 inches.

21. A hand-held starter apparatus for starting model engines, the apparatus comprising a motor including a shaft that is rotatable about a motor axis, a trigger coupled to the motor to activate the motor to rotate the shaft to start a model engine, and a body having an interior region in which at least a portion of the motor is situated, the body being configured to be hand held, the body having a front end and a rear end, the body including an elongated main portion extending between the front end and the rear end, the elongated main portion having a body axis, the body including a front ridge extending from the elongated main portion, the front ridge being spaced apart from the front end, at least a majority of an outer surface of the body that intersects a first plane which is perpendicular to the body axis adjacent the front end being defined by a circle having a diameter of about 1.6 inches.

22. The apparatus of claim 21, wherein at least a majority of the outer surface of the body that intersects a second plane which is parallel with the first plane and which is spaced apart from the first plane by a distance of about 2.5 inches is defined by an ellipse having a major axis and having a minor axis extending in perpendicular relation to the major axis, the major axis is about 1.69 inches, and the minor axis is about 1.62 inches.

23. The apparatus of claim 21, wherein at least a majority of the outer surface of the body that intersects a second plane which is parallel with the first plane and which is spaced apart from the first plane by a distance of about 3.3 inches is defined by an ellipse having a major axis and a minor axis extending in perpendicular relation to the major axis, the major axis is about 1.65 inches, and the minor axis is about 1.47 inches.

24. The apparatus of claim 21, wherein at least a majority of the outer surface of the body that intersects a second plane which is parallel with the first plane and which is spaced apart from the first plane by a distance of about 4.1 inches is defined by an ellipse having a major axis and a minor axis extending in perpendicular relation with the major axis, the major axis is about 1.56 inches, and the minor axis is about 1.26 inches.

25. The apparatus of claim 21, wherein at least a majority of the outer surface of the body that intersects a second plane which is parallel with the first plane and which is spaced apart from the first plane by a distance of about 4.9 inches is defined by an ellipse having a major axis and a minor axis extending in perpendicular relation to the major axis, the major axis is about 1.43 inches, and the minor axis is about 1 inch.

26. The apparatus of claim 21, wherein at least a majority of the outer surface of the body that intersects a second plane which is parallel with the first plane and which is spaced apart from the first plane by a distance of about 5.7 inches is defined by an ellipse having a major axis and a minor axis extending in perpendicular relation to the major axis, the major axis is about 1.26 inches, and the minor axis is about 0.8 inches.

27. A hand-held starter apparatus for starting model engines, the apparatus comprising a motor including a shaft that is rotatable about a motor axis, a trigger coupled to the motor to activate the motor to rotate the shaft to start a model engine, a body having an interior region in which at least a portion of the motor is situated, the body being configured to be hand held, the body having a front end and a rear end, the body including an elongated main portion extending between the front end and the rear end, the elongated main portion having a body axis, the body including a front ridge extending from the elongated main portion, the front ridge being spaced apart from the front end, the front ridge being adapted for receipt between the pointer and index fingers of an operator's hand, and a power pack appended to the body and the power pack including at least one battery that supplies power to the motor.

28. A hand-held starter apparatus for starting model engines, the apparatus comprising a motor including a shaft that is rotatable about a motor axis, a trigger coupled to the motor to activate the motor to rotate the shaft to start a model engine, and a body having an interior region in which at least a portion of the motor is situated, the body being configured to be hand held, the body having a front end and a rear end, the body including an elongated main portion extending between the front end and the rear end, the elongated main portion having a body axis, the body including a front ridge extending from the elongated main portion, the front ridge being spaced apart from the front end, at least a portion of the trigger extending from the body between the front end of the body and the front ridge.

29. A hand-held starter apparatus for starting model engines, the apparatus comprising a motor including a shaft that rotates about a motor axis when the motor is activated to start a model engine, and a body having an interior region in which at least a portion of the motor is situated, the body being configured to be hand held, the body having a front end and a rear end, the body including an elongated main portion extending between the front end and the rear end along a body axis, the elongated main portion including an outer surface having a circular cross section along a first plane that extends adjacent the front end in perpendicular relation with the body axis, the outer surface having an oval cross section along a second plane that extends adjacent the rear end in perpendicular relation with the body axis, and the outer surface of the elongated main portion transitions smoothly from the circular cross section to the oval cross section.

30. The apparatus of claim 29, wherein the body axis is substantially coaxial with the motor axis.

31. The apparatus of claim 29, wherein the circular cross section is defined by a circle having a diameter of about 1.6 inches.

32. The apparatus of claim 29, wherein the outer surface has an intermediate cross section along a third plane that is parallel with the first plane and that is spaced apart from the first plane by a distance of about 2.5 inches and the intermediate cross section is defined by an oval having a height diameter of about 1.69 inches and having a width diameter of about 1.62 inches.

33. The apparatus of claim 29, wherein the outer surface has an intermediate cross section along a third plane that is parallel with the first plane and that is spaced apart from the first plane by a distance of about 3.3 inches and the intermediate cross section is defined by an oval having a height diameter of about 1.65 inches and having a width diameter of about 1.47 inches.

34. The apparatus of claim 29, wherein the outer surface has an intermediate cross section along a third plane that is parallel with the first plane and that is spaced apart from the first plane by a distance of about 4.1 inches and the intermediate cross section is defined by an oval having a height diameter of about 1.56 inches and having a width diameter of about 1.26 inches.

35. The apparatus of claim 29, wherein the outer surface has an intermediate cross section along a third plane that is parallel with the first plane and that is spaced apart from the first plane by a distance of about 4.9 inches and the intermediate cross section is defined by an oval having a height diameter of about 1.43 inches and having a width diameter of about 1 inch.

36. The apparatus of claim 29, wherein the second plane is spaced apart from the first plane by about 5.7 inches and the oval cross section is defined by an oval having a height diameter of about 1.26 inches and having a width diameter of about 0.8 inches.

37. The apparatus of claim 29, wherein the outer surface has an intermediate cross section along a third plane that is parallel with the second plane and that is spaced apart from the second plane by a distance of about 3.2 inches and the intermediate cross section is defined by an oval having a height diameter of about 1.69 inches and having a width diameter of about 1.62 inches.

38. The apparatus of claim 29, wherein the outer surface has an intermediate cross section along a third plane that is parallel with the second plane and that is spaced apart from the second plane by a distance of about 2.4 inches and the intermediate cross section is defined by an oval having a height diameter of about 1.65 inches and having a width diameter of about 1.47 inches.

39. The apparatus of claim 29, wherein the outer surface has an intermediate cross section along a third plane that is parallel with the second plane and that is spaced apart from the second plane by a distance of about 1.6 inches and the intermediate cross section is defined by an oval having a height diameter of about 1.56 inches and having a width diameter of about 1.26 inches.

40. The apparatus of claim 29, wherein the outer surface has an intermediate cross section along a third plane that is parallel with the second plane and that is spaced apart from the second plane by a distance of about 0.8 inches and the intermediate cross section is defined by an oval having a height diameter of about 1.43 inches and having a width diameter of about 1 inch.

41. The apparatus of claim 29, wherein the body includes a front ridge appended to the elongated main portion and extending therefrom.

42. The apparatus of claim 41, wherein the body includes a rear ridge appended to the elongated main portion and extending therefrom, and the front ridge is spaced apart from the rear ridge to define a finger-receiving space therebetween.

43. The apparatus of claim 42, wherein the front ridge and the rear ridge are both positioned to lie between the first plane and the second plane.

44. The apparatus of claim 42, wherein the front ridge includes a front distal tip spaced apart from the elongated main portion, the front ridge blends smoothly with the elongated main portion from the front distal tip along a first arc having a first radius positioned to lie forward of the front distal tip, and the front ridge blends smoothly with the elongated main portion from the front distal tip along a second arc having a second radius positioned to lie rearward of the front distal tip.

45. The apparatus of claim 44, wherein the first radius is longer than the second radius.

46. The apparatus of claim 44, wherein the first radius is about twice as long as the second radius.

47. The apparatus of claim 44, wherein the first radius is about 0.8 inches and the second radius is about 0.4 inches.

48. The apparatus of claim 44, wherein a center of the first arc is spaced apart from a center of the second arc by about 1.3 inches.

49. The apparatus of claim 44, wherein the rear ridge includes a rear distal tip spaced apart from the elongated main portion, the rear ridge blends smoothly with the elongated main portion from the rear distal tip along a third arc having a third radius positioned to lie forward of the rear distal tip.

50. The apparatus of claim 49, wherein the first radius is longer than the third radius and the second radius is shorter than the third radius.

51. The apparatus of claim 49, wherein the third radius is approximately a mean of a sum of the first radius and the second radius.

52. The apparatus of claim 49, wherein the first radius is about 0.8 inches, the second radius is about 0.4 inches, and the third radius is about 0.6 inches.

53. The apparatus of claim 49, wherein the front distal tip is spaced apart from the rear distal tip by a distance of about 4 inches.

54. The apparatus of claim 42, wherein the rear ridge includes a rear distal tip spaced apart from the elongated main portion, the rear ridge blends smoothly with the elongated main portion from the rear distal tip along an arc having a radius positioned to lie forward of the rear distal tip.

55. The apparatus of claim 54, wherein the radius is about 0.6 inches.

56. The apparatus of claim 29, further comprising a trigger coupled to the body, the trigger is movable relative to the body to activate the motor, and the trigger is an elongated element having a length that is at least half of a distance between the first plane and the second plane.

57. The apparatus of claim 56, wherein the trigger pivots relative to the body about a trigger axis that is parallel with the first plane.

58. The apparatus of claim 57, wherein the trigger axis is closer to the second plane than the first plane.

59. The apparatus of claim 56, wherein the body includes a front guard extending away from the elongated main portion adjacent the front end of the body, the trigger includes a distal end spaced apart from the trigger axis, and the distal end of the trigger confronts the front guard.

60. The apparatus of claim 59, wherein the elongated main portion and the front guard are configured so that as the apparatus is rolled on a flat surface, no portion of the flat surface contacts the trigger.

61. The apparatus of claim 56, wherein the trigger includes a hand-engaging surface that faces away from the body, at least a portion of the hand-engaging surface curves relative to the body along an arc having a radius of about 3.5 inches.

62. The apparatus of claim 29, further comprising a ridge appended to the body and a trigger situated alongside the ridge, and the trigger being movable to activate the motor.

63. The apparatus of claim 29, further comprising at least one wire coupled to the motor to supply power to the motor, the rear end of the body being formed to include an opening that is positioned to lie on the body axis, and the at least one wire extends through the opening.

64. The apparatus of claim 29, further comprising a power pack appended to the body and the power pack including at least one battery that supplies power to the motor.

65. A hand-held starter apparatus for starting model engines, the apparatus comprising a body having a front end, a rear end spaced apart from the front end, and a main portion extending between the front end and the rear end, the main portion being formed to include an interior region between the front end and the rear end, the body being configured to be hand held, a motor situated in the interior region adjacent the front end, the motor being configured to start a model engine when the motor is activated, a switch situated in the interior region between the motor and the rear end, the switch being coupled to the motor and operable to activate the motor, and a trigger having a first portion positioned to lie in the interior region and a second portion positioned to lie outside the interior region, the first portion being coupled to the body for pivoting movement about a trigger axis that is located between the switch and the rear end, and moving the trigger operates the switch to activate the motor.

66. The apparatus of claim 65, wherein the main portion of the body extends between the front end and the rear end along a body axis, the main portion includes an outer surface having a first cross section along a first plane perpendicular to the body axis adjacent the front end, and the first cross section is defined by a circle having a center on the body axis.

67. The apparatus of claim 66, wherein the outer surface of the main portion has a second cross section along a second plane perpendicular to the body axis adjacent the rear end and the second cross section is defined by an ellipse having a major axis that intersects the body axis and having a minor axis that intersects the body axis.

68. The apparatus of claim 65, wherein the body includes a front guard extending away from the main portion adjacent the front end of the body, the trigger includes a distal end spaced apart from the trigger axis, and the distal end of the trigger confronts the front guard.

69. The apparatus of claim 68, wherein the main portion and the front guard are configured so that as the apparatus is rolled on a flat surface, no portion of the flat surface contacts the trigger.

70. The apparatus of claim 65, wherein the body includes a front ridge appended to the main portion and extending therefrom, the body includes a rear ridge appended to the main portion and extending therefrom, and the front ridge is spaced apart from the rear ridge to define a finger-receiving space therebetween.

71. The apparatus of claim 70, wherein the front ridge includes a front distal tip spaced apart from the main portion, the front ridge blends smoothly with the main portion from the front distal tip along a first arc having a first radius positioned to lie forward of the front distal tip, and the front ridge blends smoothly with the main portion from the front distal tip along a second arc having a second radius positioned to lie rearward of the front distal tip.

72. The apparatus of claim 71, wherein the first radius is longer than the second radius.

73. The apparatus of claim 71, wherein the first radius is about twice as long as the second radius.

74. The apparatus of claim 71, wherein the first radius is about 0.8 inches and the second radius is about 0.4 inches.

75. The apparatus of claim 71, wherein a center of the first arc is spaced apart from a center of the second arc by about 1.3 inches.

76. The apparatus of claim 71, wherein the rear ridge includes a rear distal tip spaced apart from the main portion, the rear ridge blends smoothly with the main portion from the rear distal tip along a third arc having a third radius positioned to lie forward of the rear distal tip.

77. The apparatus of claim 76, wherein the first radius is longer than the third radius and the second radius is shorter than the third radius.

78. The apparatus of claim 76, wherein the third radius is approximately a mean of a sum of the first radius and the second radius.

79. The apparatus of claim 76, wherein the first radius is about 0.8 inches, the second radius is about 0.4 inches, and the third radius is about 0.6 inches.

80. The apparatus of claim 76, wherein the front distal tip is spaced apart from the rear distal tip by a distance of about 4 inches.

81. The apparatus of claim 70, wherein the rear ridge includes a rear distal tip spaced apart from the main portion, the rear ridge blends smoothly with the main portion from the rear distal tip along an arc having a radius positioned to lie forward of the rear distal tip.

82. The apparatus of claim 81, wherein the radius is about 0.6 inches.

83. The apparatus of claim 65, wherein the trigger includes a hand-engaging surface that faces away from the body, at least a portion of the hand-engaging surface curves along an arc having a radius of about 3.5 inches.

84. The apparatus of claim 65, wherein at least a majority of an outer surface of the body that intersects a first plane which is perpendicular to the body axis adjacent the front end is defined by a circle having a diameter of about 1.6 inches.

85. The apparatus of claim 84, wherein at least a majority of the outer surface of the body that intersects a second plane which is parallel with the first plane and which is spaced apart from the first plane by a distance of about 2.5 inches is defined by an oval having a height diameter extending in perpendicular relation with the trigger axis and having a width diameter extending in parallel relation with the trigger axis, the height diameter is about 1.69 inches, and the width diameter is about 1.62 inches.

86. The apparatus of claim 84, wherein at least a majority of the outer surface of the body that intersects a second plane which is parallel with the first plane and which is spaced apart from the first plane by a distance of about 3.3 inches is defined by an oval having a height diameter extending in perpendicular relation with the trigger axis and having a width diameter extending in parallel relation with the trigger axis, the height diameter is about 1.65 inches, and the width diameter is about 1.47 inches.

87. The apparatus of claim 84, wherein at least a majority of the outer surface of the body that intersects a second plane which is parallel with the first plane and which is spaced apart from the first plane by a distance of about 4.1 inches is defined by an oval having a height diameter extending in perpendicular relation with the trigger axis and having a width diameter extending in parallel relation with the trigger axis, the height diameter is about 1.56 inches, and the width diameter is about 1.26 inches.

88. The apparatus of claim 84, wherein at least a majority of the outer surface of the body that intersects a second plane which is parallel with the first plane and which is spaced apart from the first plane by a distance of about 4.9 inches is defined by an oval having a height diameter extending in perpendicular relation with the trigger axis and having a width diameter extending in parallel relation with the trigger axis, the height diameter is about 1.43 inches, and the width diameter is about 1 inch.

89. The apparatus of claim 84, wherein at least a majority of the outer surface of the body that intersects a second plane which is parallel with the first plane and which is spaced apart from the first plane by a distance of about 5.7 inches is defined by an oval having a height diameter extending in perpendicular relation with the trigger axis and having a width diameter extending in parallel relation with the trigger axis, the height diameter is about 1.26 inches, and the width diameter is about 0.8 inches.

90. The apparatus of claim 65, further comprising at least one wire coupled to the motor to supply power to the motor, the rear end of the body being formed to include an opening that is positioned to lie on the body axis, and the at least one wire extends through the opening.

91. The apparatus of claim 65, further comprising a power pack appended to the body and the power pack including at least one battery that supplies power to the motor.

92. A hand-held starter apparatus for starting model engines, the apparatus comprising a motor including a shaft that rotates about a motor axis when the motor is activated to start a model engine, and a body having an interior region in which at least a portion of the motor is situated, the body being configured to be hand held, the body having a front end and a rear end, the body including an elongated main portion extending between the front end and the rear end along a body axis, the elongated main portion including an outer surface having a first cross section with a first cross-sectional area taken along a first plane that extends adjacent the front end in perpendicular relation with the body axis, the outer surface having a second cross section with a second cross-sectional area taken along a second plane that extends adjacent the rear end in perpendicular relation with the body axis, the outer surface of the elongated main portion transitions smoothly from the first cross section to the second cross section, and the second cross-sectional area is less than the first cross-sectional area, the second cross-sectional area being about one half the first cross-sectional area.

93. The apparatus of claim 92, wherein the first cross section and the second cross section are spaced apart along the body axis by about 2.4 inches, the first cross-sectional area is about 2.07 square inches, and the second cross-sectional area is about 1.10 square inches.

94. The apparatus of claim 92, further comprising a switch coupled to the motor and operable to activate the motor, and a trigger situated on the main portion of the body between the front end and the rear end and coupled to the switch to operate the switch and activate the motor.

95. The apparatus of claim 94, wherein the body includes a front guard extending away from the main portion adjacent the front end of the body, and the body and front guard are configured so that as the apparatus is rolled on a flat surface, no portion of the flat surface contacts the trigger.

96. The apparatus of claim 92, wherein the body includes a front ridge appended to the main portion and extending therefrom, the body includes a rear ridge appended to the main portion and extending therefrom, and the front ridge is spaced apart from the rear ridge to define a finger-receiving space therebetween.

97. A hand-held starter apparatus for starting a model engine, the apparatus comprising an electric motor including a shaft that is rotatable about a motor axis, a body having an interior region in which at least a portion of the electric motor is situated, the body being configured to be hand held, the body having a front end and a rear end, the body including an elongated main portion extending between the front end and the rear end, the elongated main portion having a body axis, the body including a front ridge extending from the elongated main portion adjacent the front end and a rear ridge extending from the elongated main portion adjacent the rear end, the front ridge being spaced apart from the rear ridge to define a finger-receiving space therebetween, the finger receiving space lying on a first side of the body axis, an adapter coupled to the shaft to rotate therewith, the adapter being adapted to be coupled to the model engine to transfer rotational motion from the shaft to the model engine to start the model engine, means for activating the motor, the activating means comprising a user-engageable portion that is situated between the front end and the rear end on a second side of the body axis, the second side of the body axis being diametrically opposite the first side of the body axis, and a guard extending away from the main portion in front of the user-engageable portion on the second side of the body axis, the body and the guard being configured so that when the apparatus is placed on a flat surface in any orientation having the body and guard contacting the flat surface, no portion of the flat surface contacts the user-engageable portion.

98. The apparatus of claim 97, wherein the elongated main portion includes an outer surface having a first cross section with a first cross-sectional area taken along a first plane that extends adjacent the front end in perpendicular relation with the body axis, the outer surface having a second cross section with a second cross-sectional area taken along a second plane that extends adjacent the rear end in perpendicular relation with the body axis, the outer surface of the elongated main portion transitions smoothly from the first cross section to the second cross section, and the second cross-sectional area is less than the first cross-sectional area, the second cross sectional area being about one-half the first cross section area.

99. The apparatus of claim 98, wherein the first cross section and second cross section are spaced apart along the body axis by about 2.4 inches, the first cross-sectional area is about 2.07 square inches, and the second cross-sectional area is about 1.10 square inches.

100. A hand-held starter apparatus for starting a model engine, the apparatus comprising a motor including a shaft that is rotatable about a motor axis, a body having an interior region in which at least a portion of the motor is situated, the body being configured to be hand-held, the body including an elongated main portion having a front end and a rear end and a ridge extending from the elongated main portion and being spaced apart from the front end and from the rear end to define a trigger space between the ridge and the front end, and a trigger coupled to the motor to activate the motor to rotate the shaft to start a model engine, at least a portion of the trigger extending from the elongated main portion into the trigger space.

101. The apparatus of claim 100, wherein the elongated main portion has a body axis, the elongated main portion includes an outer surface having a first cross section with a first cross-sectional area taken along a first plane that extends adjacent the front end in perpendicular relation with the body axis, the outer surface having a second cross section with a second cross-sectional area taken along a second plane that extends adjacent the rear end in perpendicular relation with the body axis, the outer surface of the elongated main portion transitions smoothly from the first cross section to the second cross section, and the second cross-sectional area is less than the first cross-sectional area, the second cross sectional area being about one-half the first cross section area.

102. The apparatus of claim 100, wherein the first cross section and second cross section are spaced apart along the body axis by about 2.4 inches, the first cross-sectional area is about 2.07 square inches, and the second cross-sectional area is about 1.10 square inches.

* * * * *